US011408325B2

(12) United States Patent
Zuehl et al.

(10) Patent No.: US 11,408,325 B2
(45) Date of Patent: Aug. 9, 2022

(54) V-TWIN ENGINE ASSEMBLY

(71) Applicant: Briggs & Stratton, LLC, Wauwatosa, WI (US)

(72) Inventors: Jacob Zuehl, Hartland, WI (US); Michael Pitcel, Waukesha, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 89 days.

(21) Appl. No.: 16/746,740

(22) Filed: Jan. 17, 2020

(65) Prior Publication Data

US 2020/0232379 A1 Jul. 23, 2020

Related U.S. Application Data

(60) Provisional application No. 62/794,323, filed on Jan. 18, 2019.

(51) Int. Cl.

| | |
|---|---|
| ***F01P 5/02*** | (2006.01) |
| ***F01P 1/02*** | (2006.01) |
| ***F02D 9/02*** | (2006.01) |
| ***F01P 1/06*** | (2006.01) |

(52) U.S. Cl.

CPC ..... *F01P 5/02* (2013.01); *F01P 1/02* (2013.01); *F02D 9/02* (2013.01); *F01P 1/06* (2013.01); *F01P 2001/023* (2013.01); *F01P 2005/025* (2013.01); *F02D 2009/0208* (2013.01)

(58) Field of Classification Search

CPC ..... F01D 9/02; F01P 1/06; F01P 1/02; F01P 5/02

See application file for complete search history.

(56) References Cited

U.S. PATENT DOCUMENTS

| | | | | |
|---|---|---|---|---|
| 9,650,976 | B2 | 5/2017 | Gingrich et al. | |
| 9,945,281 | B2 | 4/2018 | Pitcel et al. | |
| 10,197,025 | B2 | 2/2019 | Pitcel et al. | |
| 2005/0066643 | A1* | 3/2005 | Fukushima | A01D 34/006 56/16.7 |
| 2005/0217625 | A1* | 10/2005 | Niaken | F02M 35/0203 123/184.21 |
| 2009/0090576 | A1* | 4/2009 | Nishizawa | F02M 35/162 180/219 |
| 2010/0263343 | A1* | 10/2010 | Horvat | F02M 35/0203 55/493 |
| 2014/0261259 | A1* | 9/2014 | Sullivan | F02F 7/007 123/41.65 |

FOREIGN PATENT DOCUMENTS

WO WO-2019/023548 A1 1/2019

* cited by examiner

*Primary Examiner* — Kevin A Lathers
(74) *Attorney, Agent, or Firm* — Foley & Lardner LLP

(57) ABSTRACT

One embodiment of the invention relates to an internal combustion engine including an engine block, a crankshaft configured to rotate about a crankshaft axis, a flywheel coupled to the crankshaft, a throttle body, an electric fan, and an air filter assembly configured to filter incoming air from an air intake and provide cleaned air to a throttle body. The engine block includes a cylinder. The throttle body is configured to throttle incoming air to the cylinder.

19 Claims, 32 Drawing Sheets

V-TWIN ENGINE ASSEMBLY

CROSS-REFERENCE TO RELATED APPLICATION

This application claims priority to U.S. Application No. 62/794,323, filed on Jan. 18, 2019, which is incorporated herein by reference in its entirety.

BACKGROUND

The present invention relates generally to the fields of small internal combustion engines and outdoor power equipment. More specifically, the disclosure relates to the fields of V-Twin, two cylinder, internal combustion engines and the systems integrated within such an engine.

SUMMARY

One embodiment of the invention relates to an internal combustion engine including an engine block, a crankshaft configured to rotate about a crankshaft axis, a flywheel coupled to the crankshaft, a throttle body, an electric fan, and an air filter assembly configured to filter incoming air from an air intake and provide cleaned air to a throttle body. The engine block includes a cylinder. The throttle body is configured to throttle incoming air to the cylinder. The electric fan may be positioned adjacent the cylinder.

Another embodiment of the invention relates to a zero-turn mower including a user seat, a first rear wheel and a second rear wheel, a mounting platform, and an internal combustion engine positioned on the mounting platform between the first rear wheel and the second rear wheel. The engine includes an engine block, a crankshaft configured to rate about a crankshaft axis, a flywheel coupled to the crankshaft, a throttle body, and an air filter assembly configured to filter incoming air from an air intake and provide cleaned air to a throttle body, wherein the air filter assembly comprises one or more filter elements each positioned within a receptacle and configured to provide two stages of filtration. The engine block includes a first cylinder and a second cylinder. The throttle body is configured to throttle incoming air to the first cylinder and the second cylinder.

Another embodiment of the invention relates to an internal combustion engine including an engine block, a crankshaft configured to rotate about a crankshaft axis, a flywheel coupled to the crankshaft axis, a throttle body, a first fuel delivery injector, a second fuel delivery injector, and an air filter assembly configured to filter incoming air from an air intake and provide cleaned air to a throttle body, the air filter assembly positioned directly adjacent the flywheel. The engine block includes a first cylinder and a second cylinder. The throttle body is configured to throttle incoming air to the first cylinder and the second cylinder. The first fuel delivery injector is configured to provide fuel to the first cylinder. The second fuel delivery injector is configured to provide fuel to the second cylinder.

BRIEF DESCRIPTION OF THE DRAWINGS

The invention will become more fully understood from the following detailed description, taken in conjunction with the accompanying drawings.

DETAILED DESCRIPTION

Figure 1:
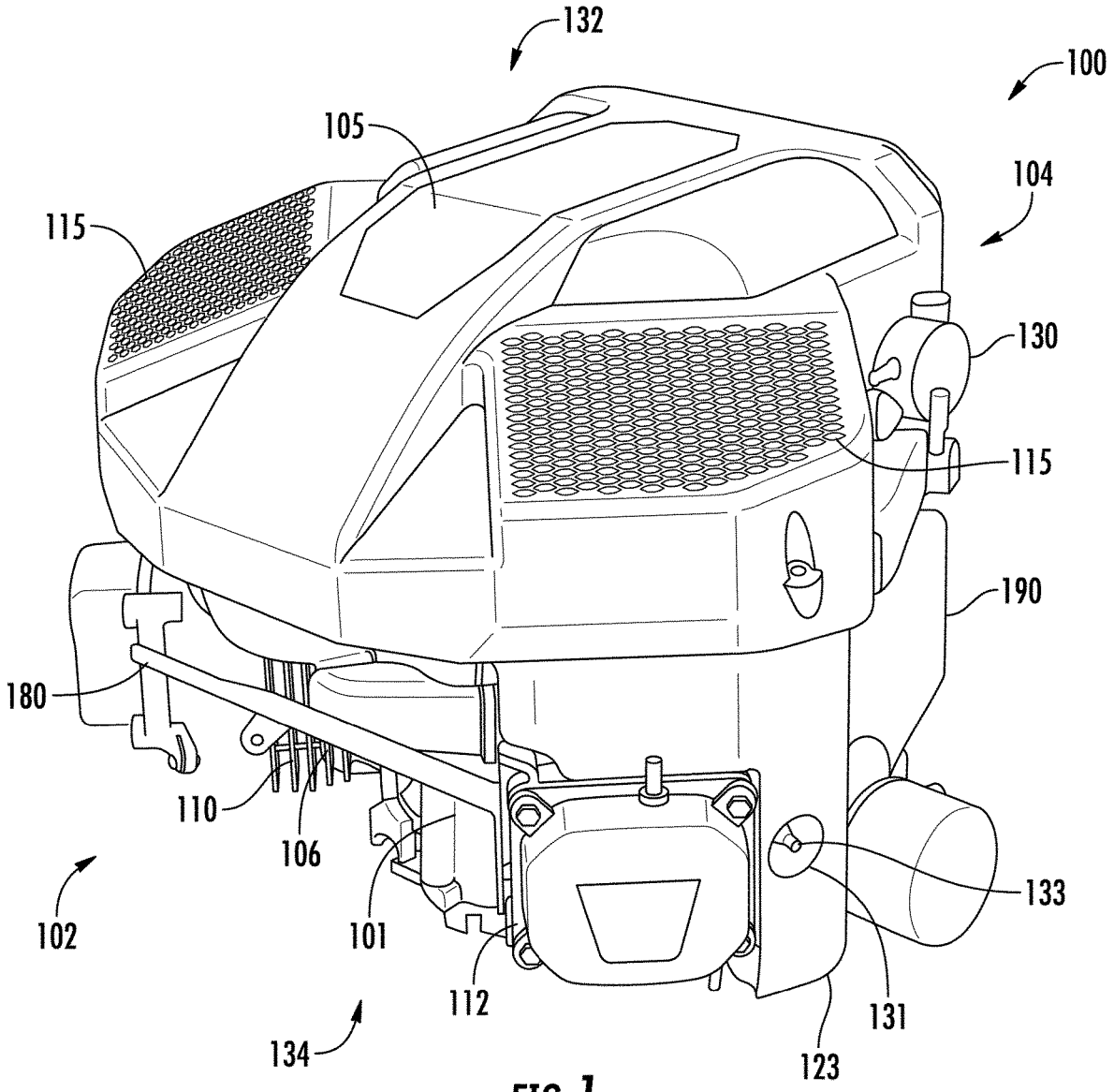
FIG. 1 is a front perspective view of an engine assembly, according to an exemplary embodiment.
Figure 2:
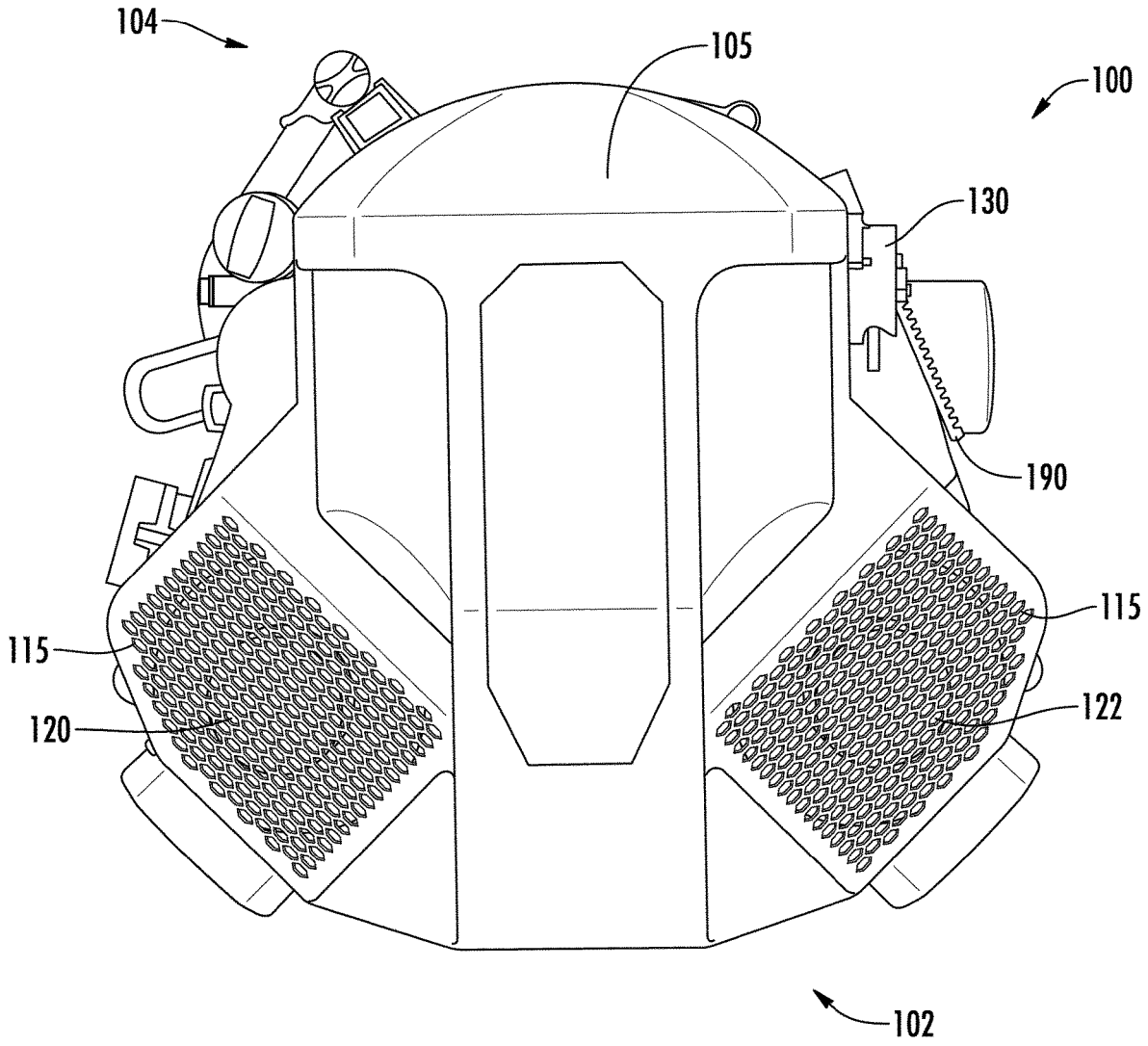
FIG. 2 is a top view of the engine assembly of FIG. 1.
Figure 3:
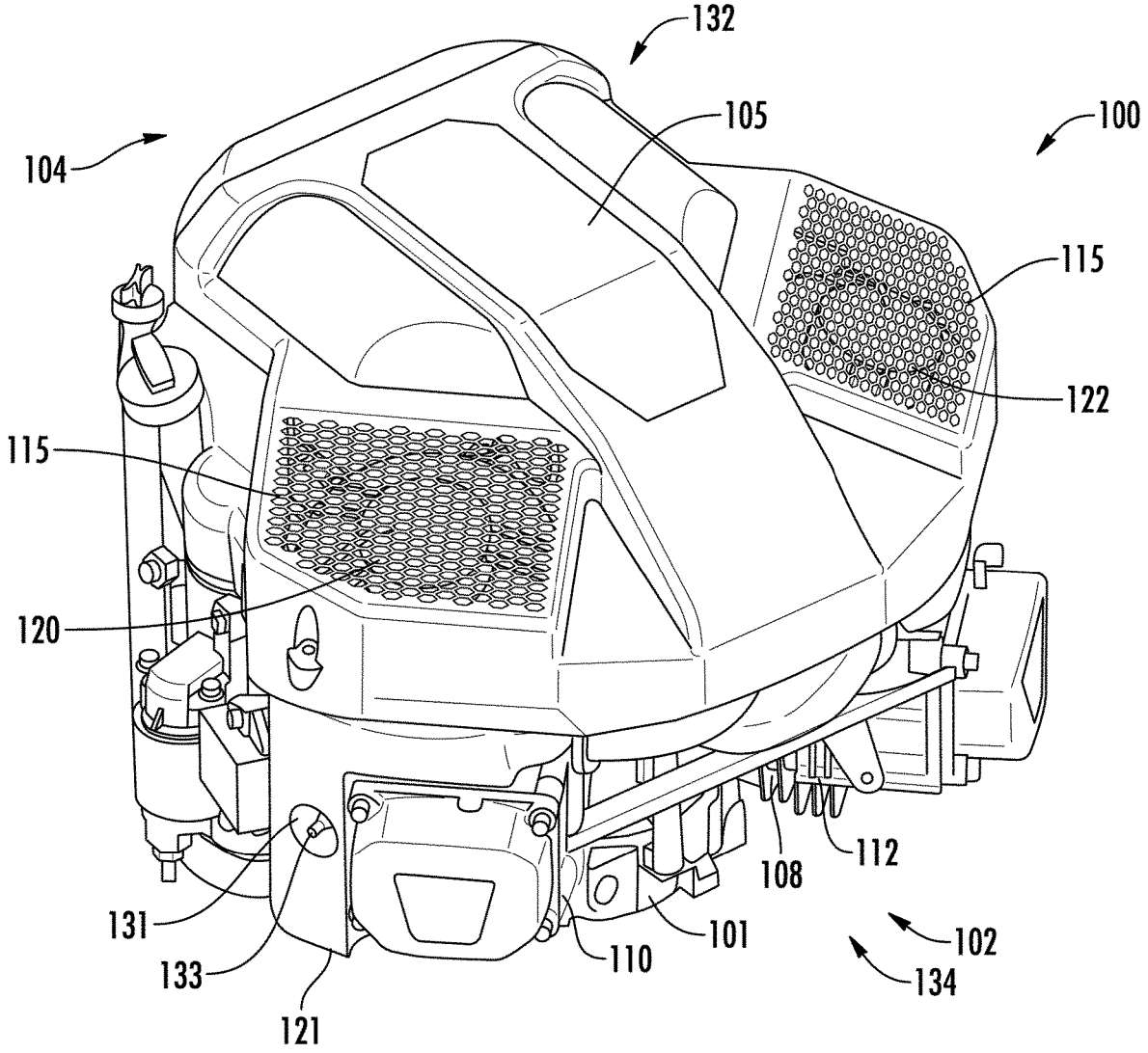
FIG. 3 is a front perspective view of the engine assembly of FIG. 1.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to the figures generally, the engine assemblies described herein may be used in outdoor power equipment, standby generators, portable jobsite equipment, or other appropriate uses. Outdoor power equipment includes lawn mowers, riding tractors, snow throwers, pressure washers, portable generators, tillers, log splitters, zero-turn radius mowers, walk-behind mowers, wide-area walk-behind mowers, riding mowers, standing mowers, industrial vehicles such as forklifts, utility vehicles, etc. Outdoor power equipment may, for example, use an internal combustion engine to drive an implement, such as a rotary blade of a lawn mower, a pump of a pressure washer, an auger of a snow thrower, the alternator of a generator, and/or a drivetrain of the outdoor power equipment. Portable jobsite equipment includes portable light towers, mobile industrial heaters, and portable light stands.

Referring now to FIGS. 1-4, an engine assembly including an internal combustion engine 100 is illustrated according to an exemplary embodiment. The internal combustion engine 100 includes a front 102, a rear 104, a top 132, and a bottom 134. The engine 100 includes an engine block 101 having a first cylinder 106, a second cylinder 108, a first cylinder head 110, and a second cylinder head 112 all positioned proximate the front 102 and near the bottom 134 of the engine 100. The engine includes two pistons each reciprocating in a cylinder 106, 108 along a cylinder axis to drive a crankshaft 103. The crankshaft 103 rotates about a crankshaft axis 107. The crankshaft 103 is positioned in part within a crankcase chamber defined by the engine block 101 and a crankcase cover 116. The illustrated engine 100 is a vertically-shafted two-cylinder engine arranged in a V-twin configuration. In further embodiments, the engine 100 can be a horizontally-shafted two-cylinder engine arranged in a V-twin configuration. In some embodiments, the engine 100 can be a single cylinder engine, either vertically or horizontally shafted. In some embodiments, a guard bar 180 extending between the cylinder heads 110, 112 is included.

The engine 100 includes a flywheel 135 coupled to the crankshaft 103 and an alternator 114 positioned beneath the flywheel 135. As the flywheel 135 rotates with the crankshaft 103, a rotating magnetic field is generated via the magnets. A portion of an alternator passes through the rotating magnetic field to induce a current. The induced current may then generate a voltage, thereby generating electrical energy from the mechanical energy associated with the rotation of the flywheel 135. In one embodiment, the alternator 114 is positioned in proximity to the flywheel 135 such that the magnetic field generated by the magnets is sufficiently concentrated to induce the desired current. The alternator is used to power all of the electrical components (e.g., electronic fuel injection system 113, electronic governor system 141, fuel delivery injector units 150, 152, etc.) of the engine 100.

Figure 5:
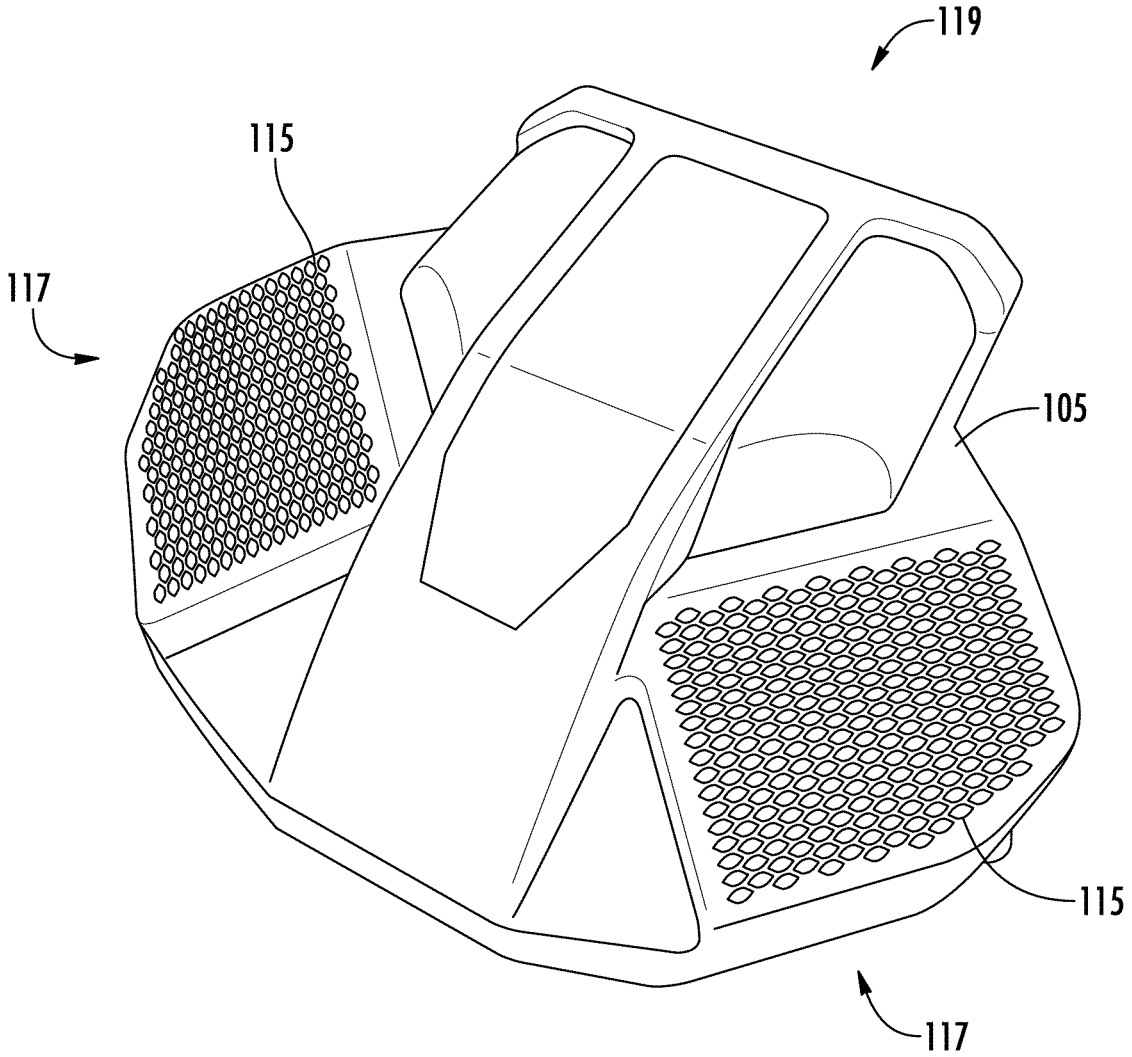
FIG. 5 is a perspective view of a housing of the engine assembly of FIG. 1.

The housing 105 is coupled to the top of the engine 100 and is configured to house various components of the engine 100 and direct cooling air over the engine block 101, cylinders 106, 108, and cylinder heads 110, 112. The housing 105 also helps to prevent debris from entering into the housing 105 and contacting and/or building up on various engine components therein. The housing 105 may be shaped to generally conform with the shape of the engine block 101 (e.g., with the V-twin arrangement). As shown in FIG. 5, the housing 105 includes two angled screen portions 117 and a filter cover portion 119. The two screen portions 117 extend outward and are generally aligned with the cylinders 106, 108 of the engine 100. The two screen portions 117 each include a screen 115 allowing air to flow into the housing 105 (e.g., via electric fans 120, 122 discussed further herein) and over the engine block 101 and cylinders 106, 108. The filter cover portion 119 covers an air filter assembly 155 (shown in FIG. 6) positioned below the housing 105. In some embodiments, each of the electric fans 120, 122 include a cover having a screen independent of the housing 105. As described further with regard to FIGS. 25-28, in this embodiment, the electric fans 120, 122 are each coupled to the screen (e.g., mechanically coupled) such that the screen moves with the fan and the resulting centrifugal forces act to disperse any debris that may be on the screen.

The engine 100 includes an electronic fuel system 109 for supplying an air-fuel mixture to each cylinder. The fuel system 109 includes an air filter assembly 155, a throttle body 140, an electronic fuel injection (EFI) system 113 including two fuel delivery injector (FDI) units 150, 152, an electronic governor system 141, and an electronic controller 111 (e.g., engine control unit, shown in FIG. 6) housed within a circuitry compartment 160. Other actuators and/or circuits may be housed within the circuitry compartment 160 and in electrical communication with the controller 111. The controller 111 controls operation of the engine 100 including the EFI system 113 and the electronic governor system 141. In some embodiments, the controller 111 also controls the operation of the electrical fans 120, 122 discussed further herein. The controller 111 may also provide control in cases of a cylinder deactivation system, where one or more of the cylinders are at least partially deactivated (e.g., not firing every power stroke).

The fuel system 109 is positioned near the top 132 of the engine 100. As discussed above, the overall engine 100 package size is more compact than a typical V-twin engine due to the incorporation of the electronic fuel system. This is, in part, due to the elimination of a carburetor, mechanical governor, and mechanical linkages, which reduces the amount of space that the electronic fuel system takes up and where the components can be located.

Figure 6:
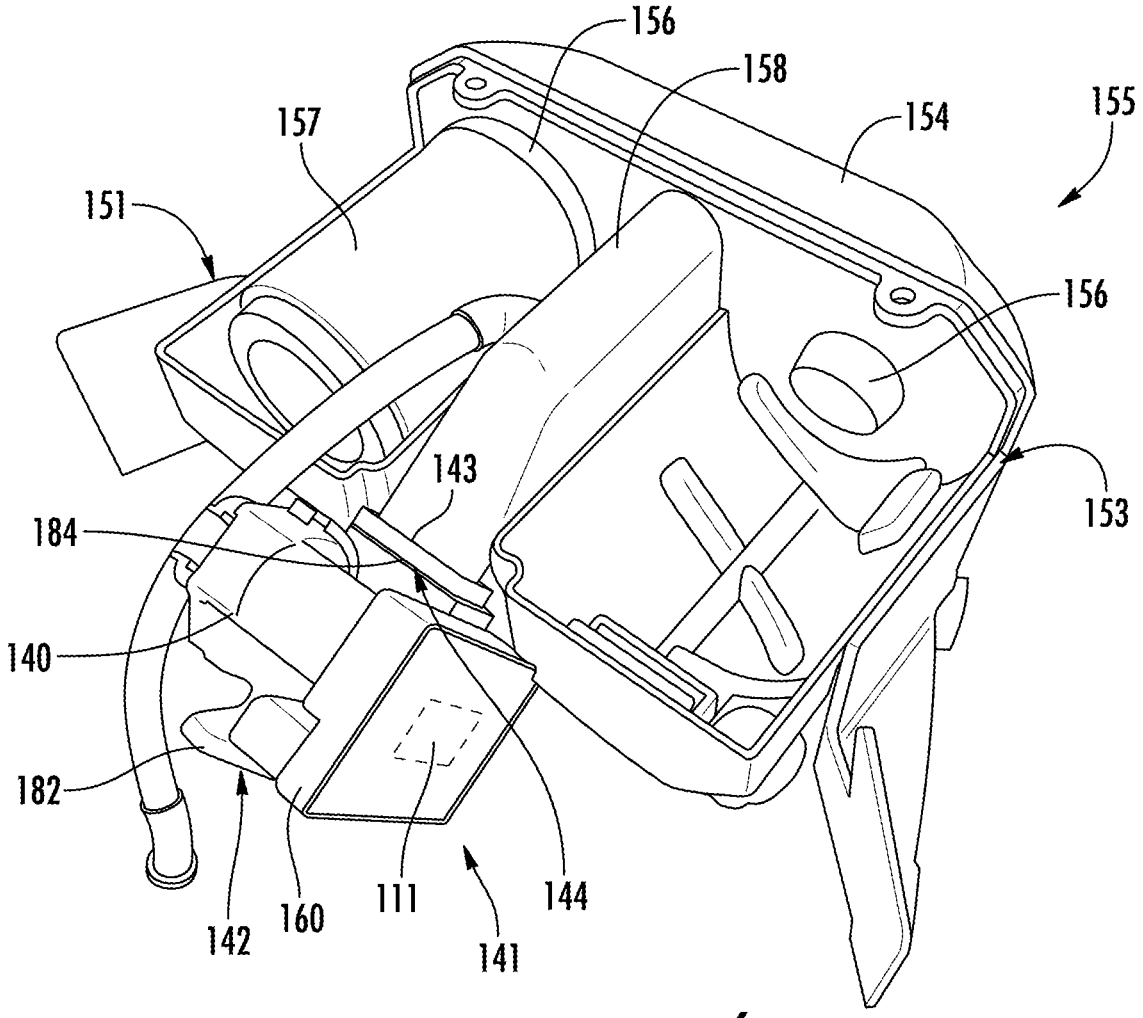
FIG. 6 is a perspective view of a portion of an air filter assembly and throttle body of the engine assembly of FIG. 1.

In addition to the overall package size of engine 100 being smaller than a typical V-twin engine, the engine incorporates two air filters (e.g., doubling the number of air filters used with a typical V-twin engine) in the air filter assembly 155. Referring to FIG. 6, the air filter assembly 155 is configured to receive and filter ambient air from an external environment received through an air intake to remove particulates (e.g., dirt, pollen, etc.) from the air. The air filter assembly 155 is configured to provide two stages of filtering of incoming air prior to supplying the filtered air to the engine 100 for combustion processes. The first filtering stage includes cyclonic filtering of incoming air through the air filter assembly 155. The cyclonic filtering is configured to remove large particles of debris prior to secondary filtering of the air. The second filtering stage includes filtering of the partially filtered air through the filter elements 157, 159 to remove smaller particles of debris from the incoming air. The filtered air is then sent to the throttle body 140 and then the intake manifold 170 of the engine 100 to be mixed with fuel prior to combustion in each cylinder 106, 108 of the engine 100. The air filter assembly 155 includes a frame 154 including a first receptacle 151 and a second receptacle 153 configured to receive respective filter elements 157, 159. The filter elements 157, 159 are horizontally oriented with the engine 100 in its normal operating position. As shown, the crankshaft 103 of the engine 100 is vertically oriented and the air filter assembly 155 is horizontally oriented.

Figure 4:
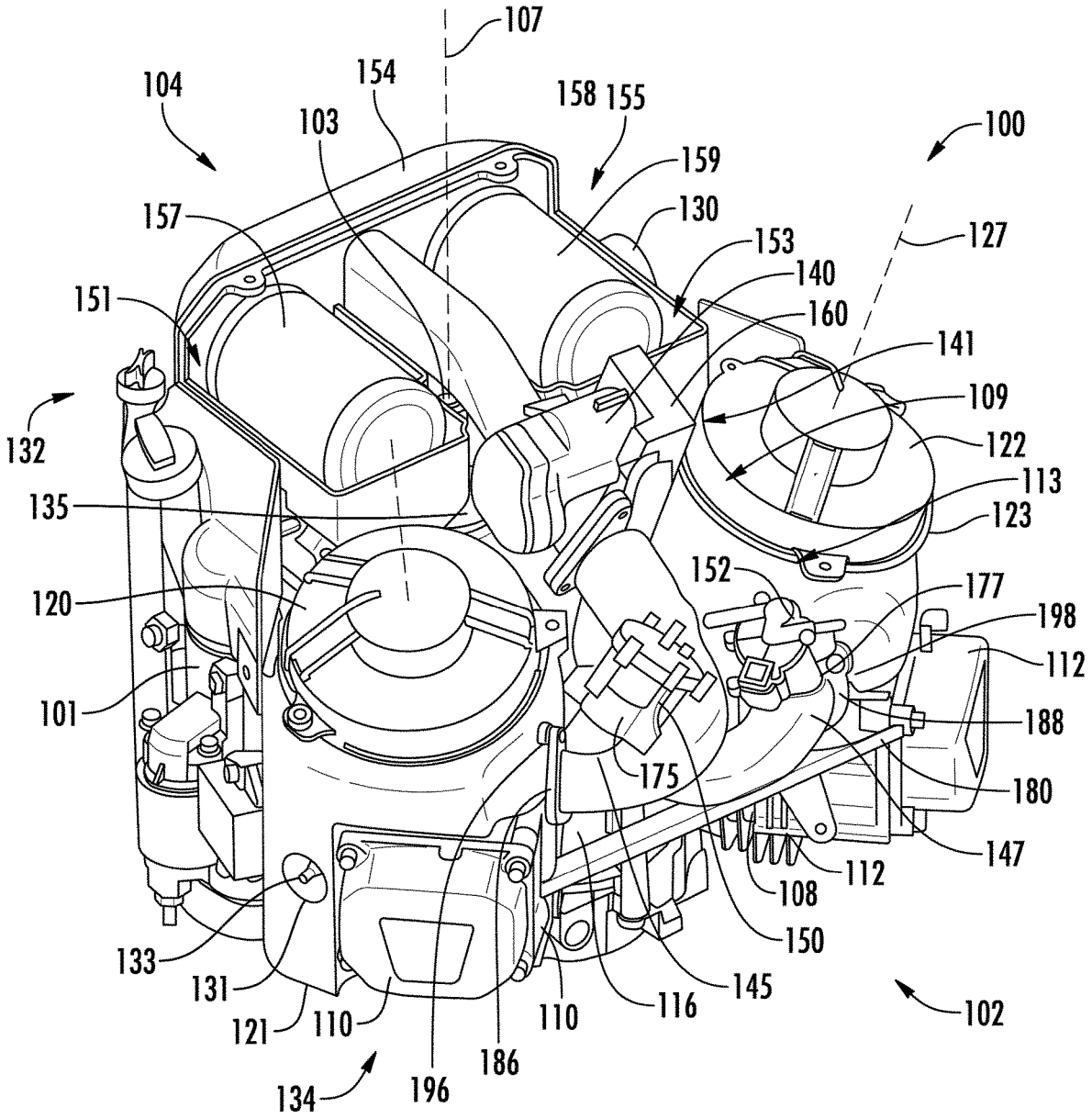
FIG. 4 is a front perspective view of the engine assembly of FIG. 1 with the housing removed.

The air filter assembly 155 is positioned near the top 132 and the rear 104 of the engine 100 as shown in FIG. 4. The air filter assembly 155 is positioned nearer the rear 104 of the engine 100 than the throttle body 140. The air filter assembly 155 is positioned directly above the flywheel 135. Accordingly, one or more filter elements 157, 159 (e.g., one or more cyclonic filters) are positioned directly above the flywheel 135. In addition, the air intake is positioned at the rear 104 of the engine 100 and opposite from the front 102 of the engine 100, where the cylinders 106, 108 and cylinder heads 110, 112 are positioned. In this way, the air intake is positioned away from (e.g., opposite from) the components of the engine 100 that typically would produce the most heat (e.g., cylinders 106, 108).

As shown in FIG. 6, the air filter assembly 155 is fluidly coupled to the throttle body 140 by a cleaned air conduit 158, such that the clean air may travel from the air filter assembly 155 to the throttle body 140. A filter outlet 156 is formed in each of the receptacles 151, 153 and is configured to direct filtered air into the cleaned air conduit 158. The filter outlet 156 is positioned within and in fluid communication with the filtered volume of the filter elements 157, 159. The cleaned air conduit 158 includes a mounting flange 143 for securing the cleaned air conduit 158 to an inlet port 184 of the throttle body 140 (e.g., via bolts or other fasteners inserted through bolt holes). The cleaned air conduit 158 is positioned between the first receptacle 151 and the second receptacle 153 and is formed as part of the frame 154. This arrangement helps to provide a relatively compact air filter assembly 155, including two filter elements 157, 159 that provide both a cyclonic filtering stage and a filter media filtering stage and a cleaned air conduit 158 within the same overall footprint of the frame 154 shown in FIG. 6.

Still referring to FIG. 6, the throttle body 140 includes an inlet 144 including inlet port 184 and an outlet 142 including an outlet port 182, and a throttle plate (not shown). The inlet 144 is configured to couple to the cleaned air conduit 158 such that the throttle body 140 receives cleaned air via the inlet port 184. The throttle plate may be selectively controlled (e.g., by electronic governor system 141) to modulate (e.g., throttle, etc.) the flow of the air exiting the throttle body 140 via the outlet port 182 and flowing through the intake manifold 170 to the cylinders 106, 108. The throttle body 140 is positioned proximate a top 132 of the engine 100 and approximately halfway between the front 102 and the rear 104 of the engine 100, thereby positioning the throttle body 140 away from the hotter portions of the engine 100 (e.g., cylinders and cylinder heads, etc.).

The electronic governor system 141 is structured to maintain a desired engine speed in response to varying loads applied to the engine 100. The electronic governor system 141 includes a motor coupled to a throttle plate via a connection device, such as a throttle shaft, to control the position of the throttle plate (e.g., open and close a throttle plate) in response to the load on the engine 100. The throttle plate controls the flow of an air/fuel mixture into the combustion chamber of the engine 100 and in doing so controls the speed of the engine 100. The throttle plate is movable between a closed position and a wide-open position. The position of the throttle plate is adjusted so that the engine speed is maintained at a desired engine speed.

Figure 8:
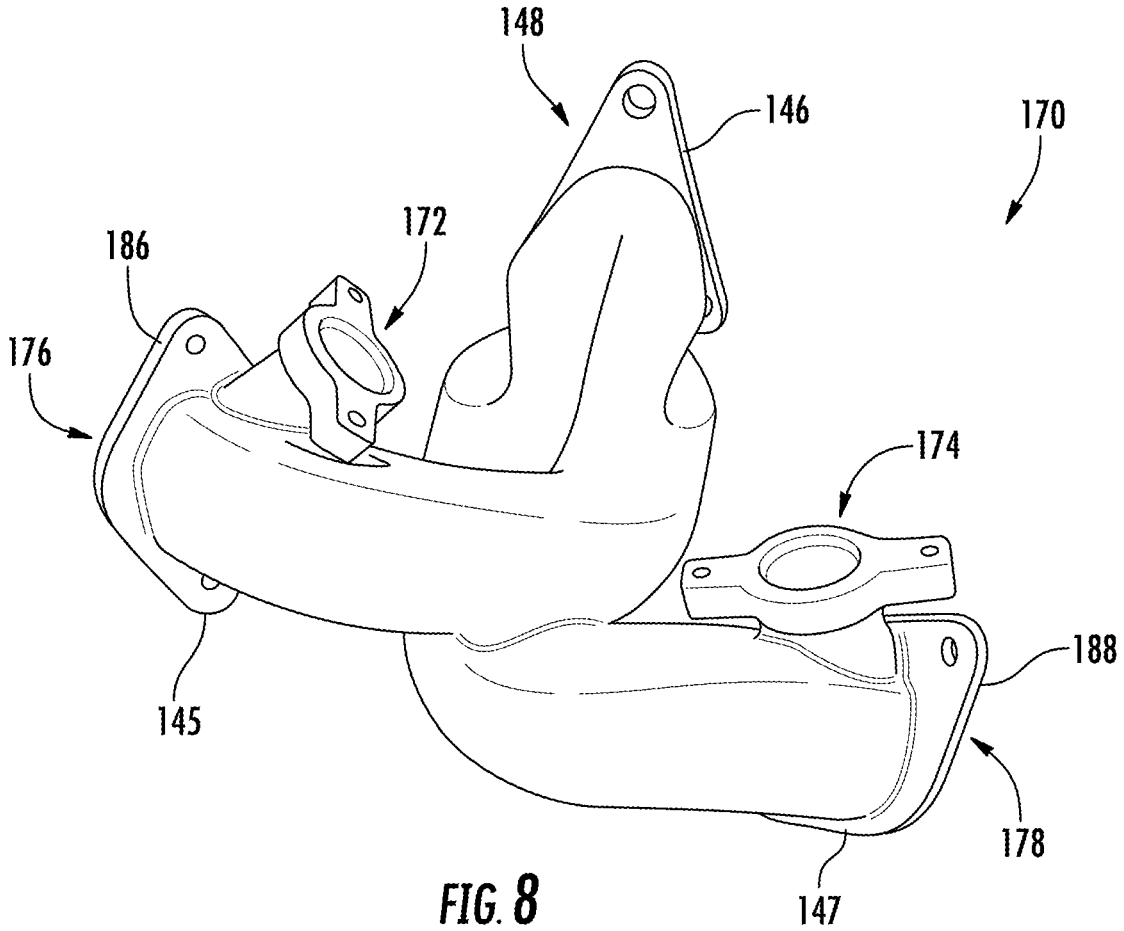
FIG. 8 is a perspective view of an intake manifold of the engine assembly of FIG. 1.

The outlet 142 of the throttle body 140 is configured to couple to an intake manifold 170 of the engine 100 shown in FIG. 8. The intake manifold 170 is positioned proximate the top 132 of the engine 100 and extends from the throttle body 140 to intake ports 196, 198 of each cylinder head 110, 112. The intake manifold 170 includes an inlet passage 148, a first outlet passage 145 terminating in a first outlet 176, and a second outlet passage 147 termination in a second outlet 178. The inlet 148 is fluidly coupled to the outlet 142 of the throttle body 140 to receive air flowing there through. The air flowing through the intake manifold 170 is evenly distributed to each intake port 196, 198 through the outlet passages 145, 147. A mounting flange 146 of the inlet 148 is secured to the outlet port 182 of the throttle body 140. A mounting flange 186 of the first outlet 176 is secured to an intake port 196 of the first cylinder head 110 and a mounting flange 188 of the second outlet 178 is secured to an intake port 198 of the second cylinder head 112 as shown in FIG. 4.

The EFI system 113 is in communication with the controller 111 and receives information and signals from the controller 111. When the EFI system 113 receives the appropriate signals from the controller 111, one or more of the FDI units 150, 152 provides fuel for combustion by the engine 100, as described further herein. The two FDI units 150, 152 are coupled to the intake manifold 170 by coupling interfaces or mounting locations 175, 177. The first FDI unit 150 is coupled to a first fuel injection port 172 via the first mounting interface 175. The second FDI unit 152 is coupled to a second fuel injection port 174 via the second mounting interface 177. The first and second fuel injection ports 172, 174 are formed integrally with the intake manifold 170. As such, the first fuel injection port 172 is formed in the first outlet passage 145 and the second fuel injection port 174 is formed in the second outlet passage 147. In this way, the first FDI unit 150 provides fuel to the first cylinder 106 via the first fuel injection port 172 and the second FDI unit 152 provides fuel to the second cylinder 108 via the second fuel injection port 174. The FDI units 150, 152 are angled relative to vertical such that the fuel is injected at an angle into the injection ports 172, 174. In further embodiments, the EFI system 113 may include other fuel injectors configured to provide fuel for combustion by the engine 100.

As shown in FIG. 4, the first and second FDI units 150, 152 are positioned proximate the top 132 and the front 102 of the engine 100. The first and second FDI units 150, 152 are positioned nearer the center of the engine 100 than the electric fans 120, 122 described below. The first and second FDI units 150, 152 are positioned away from (e.g., opposite) the muffler, which is positioned at the rear 104 of the engine 100, and away from the engine block 101, both of which can provide a significant amount of heat. Thus, the FDI units 150, 152 are positioned away from some of the hotter portions of the engine 100.

In some embodiments, a fuel pump 130 may be used to provide fuel to the FDI units 150, 152. The fuel pump 130 transfers fuel from the fuel tank to the FDI units 150, 152. The fuel pump 130 is positioned proximate the rear 104 of the engine 100. The fuel pump 130 is positioned on one side of the air filter assembly 155 as shown in FIG. 4. In this way, the fuel pump 130 is positioned in a rear corner space of the overall package of the engine 100 such that the fuel pump 130 and any fuel lines connected thereto are less likely to be hit and/or damaged during assembly and/or operation of the engine 100. The fuel pump 130 is also located away from the main heat sources of the engine 100.

Referring to FIG. 4, the electric fans 120, 122 are shown near the front 102 and toward the top 132 of the engine 100. The electric fans 120, 122 are configured to pull air axially into the housing 105 through screens 115. The electric fans 120, 122 are positioned underneath respective screen portions 117 (FIG. 5) of the housing 105. The first electric fan 120 is thus positioned substantially above the first cylinder 106 and first cylinder head 110 and the second electric fan 122 is positioned substantially above the second cylinder 108 and second cylinder head 112. As shown in FIG. 4, the first electric fan 120 and the first cylinder 106 are at least partially positioned within a first ducting portion 121 (shown separately in FIG. 7). The first electric fan 120 is mounted within the first ducting portion 121 via fasteners extending through mounting holes 129 (FIG. 7) on the first ducting portion 121. The first ducting portion 121 directs incoming air flow directly over the first cylinder 106 and first cylinder head 110 thereby increasing heat transfer from the first cylinder 106 and first cylinder head 110.

Figure 7:
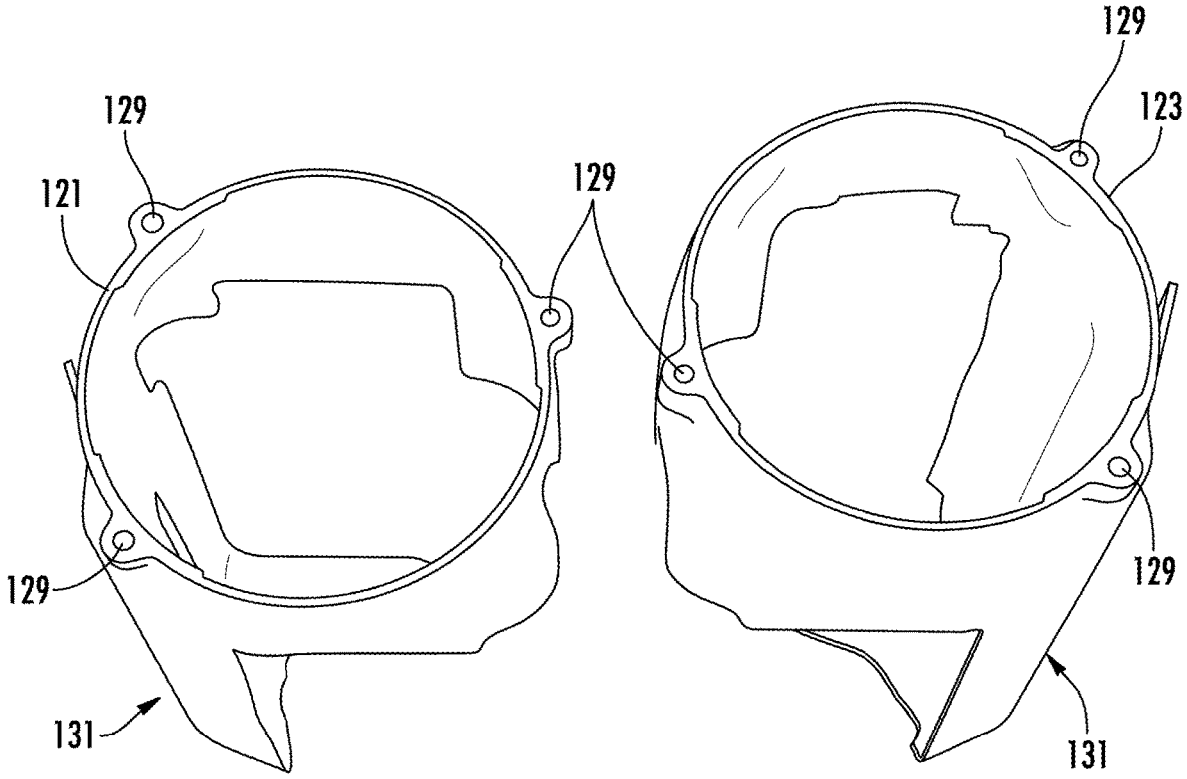
FIG. 7 is a perspective view of ducting portions of the engine assembly of FIG. 1.

The second electric fan 122 and the second cylinder 108 are at least partially positioned within a second ducting portion 123 (shown separately in FIG. 7). The second electric fan 122 is mounted within the second ducting portion 123 via fasteners extending through mounting holes 129 (FIG. 7) on the second ducting portion 123. The second housing ducting portion 123 directs incoming air flow directly over the second cylinder 108 and second cylinder head 112 thereby reducing the temperature of the second cylinder 108 and second cylinder head 112. In this way, the electric fans 120, 122 introduce cooling air directly to some of the hottest portions of the engine 100. Alternatively, or additionally, the electric fans 120, 122 may be mounted to any stationary component of the engine 100, including, but not limited to, the engine block 101, the housing 105, etc.

Each of the first and second ducting portions 121, 123 include apertures 131 through which a spark plug 133 may partially extend. In some embodiments, the spark plugs 133 do not extend past the external surface of the ducting portions 121, 123 such that the spark plugs 133 are protected from contacting external objects thereby reducing the likelihood of damage due to snagging or catching on any external objects to the engine 100.

The electric fans 120, 122 include a motor electrically connected to the alternator to receive electrical power. The electric fans 120, 122 and/or the motor may also be electrically connected to the controller 111 to receive control signals to control operation of the electric fans 120, 122. The electric motor rotates the fan blades of each electric fan 120, 122 about respective fan axes 125, 127 that are independent of the crankshaft 103. The fans do not need to be placed directly above the crankshaft 103, as the rotation of fan blades is not related to the rotation of the crankshaft 103 (i.e., the axes of rotation 125, 127 need not be collinear or parallel with the axis of rotation 107 of the crankshaft 103). According to an exemplary embodiment, the fans are propeller-type fans that create a moving column of air parallel to the axes 125, 127. The electric fans 120, 122 are mounted in a position that is tilted or angled out of the vertical plane to direct the columns of inflowing air to allow for greater airflow to specific parts of the engine 100 (e.g., directly over cylinders 106, 108 and cylinder heads 110, 112). According to another exemplary embodiment, the fans 120, 122 may not be electric fans and the power supply providing power to the fans may store or provide power in another form, such as mechanically or via a hydraulic system.

In some embodiments, the operation of the fans 120, 122 may be controlled by an electromechanical clutch system. The electromechanical clutch system engages and disengages the fan causing the starting and stopping of the rotation of the fan blades. The electromechanical clutch system operates using an electric actuation, where rotation of the fan is caused mechanically. The electromechanical clutch system may use a clutch coil that is energized (e.g., and becomes an electromagnet producing magnetic lines of flux) when the clutch is required to actuate. In this way, the fans 120, 122 are controlled through electric actuation of the clutch coil.

In some embodiments, the operation of the fans 120, 122 may be controlled by a thermostatic clutch system. The thermostatic clutch system is a temperature responsive clutch system which uses changes in temperature to engage and disengage the fans causing the starting, stopping, and control of the rotation of the fan blades. For example, if a fan is operating at a first speed when the temperature of the engine 100 is at a first temperature, the thermostatic clutch system is capable of driving the fan at a second, higher speed when the temperature of the engine 100 is at a second, higher temperature.

The inlet to the a mechanically driven fan may be restricted by an electronic actuator or wax motor to limit the quantity of air the fan has available to direct over components of the engine 100. In addition, in some embodiments, the outlet of the mechanical fan may be bypassed using an electronic actuator or wax motor. a In some embodiments, the engine 100 includes an oil cooler 190 (shown in FIG. 1). The oil cooler 190 is positioned proximate the rear 104 and bottom 134 of the engine 100. In some embodiments, the oil cooler 190 is positioned substantially underneath the fuel pump 130. The oil cooler 190 is positioned lower on the engine 100 than a typical oil cooler 190 providing for a more compact, tighter fit. The oil cooler 190 is configured to cool the oil lubricating various components of the engine 100 and thereby cool the engine 100. In some embodiments, the oil cooler 190 may have a separate, dedicated electric fan. The incorporation of electric fans 120, 122 allows the oil cooler 190 to be mounted in various positions on the engine 100 because the oil cooler 190 does not need to be mounted proximate a pressurized cooling air chamber with a mechanical fan.

Referring to FIGS. 9-12, an engine assembly including an internal combustion engine 200 is illustrated according to an exemplary embodiment. The internal combustion engine 200 includes an engine block 201 having two cylinders 206 and 208, two cylinder heads 210 and 212, two pistons, and a crankshaft 203. Each piston reciprocates in a cylinder along a cylinder axis to drive the crankshaft 203. The crankshaft 203 rotates about a crankshaft axis 207. The crankshaft 203 is positioned in part within a crankcase chamber defined by the engine block 201 and a sump or crankcase cover 216. The engine 200 also includes an electronic fuel system for supplying an air-fuel mixture to each cylinder (e.g., an electronic fuel injection system, a fuel direct injection system, an electronic governor, etc.), an air filter assembly 255, a flywheel 235, and one or more electric fans 220, 222. The engine 200 includes a housing 205 configured to direct cooling air over the engine block 201 and other components of the engine. The electric fans 220, 222 pull air into the housing 205 through a screen 215. The illustrated engine 200 is a vertically-shafted two-cylinder engine arranged in a V-twin configuration.

The components of the engine 200 shown in FIGS. 9-12 are similar to the components of engine 100 shown in FIGS. 1-8 and thus, similar reference numerals are used to refer each of the similar components. Many of the components shown in FIGS. 9-12 are also positioned on the engine 200 similar to the same components on engine 100. The cylinders 206, 208, cylinder heads 210, 212, electric fans 220, 222, FDI units 250, 252, and intake manifold 270 are all positioned similarly to the similar components on engine 100.

Figure 9:
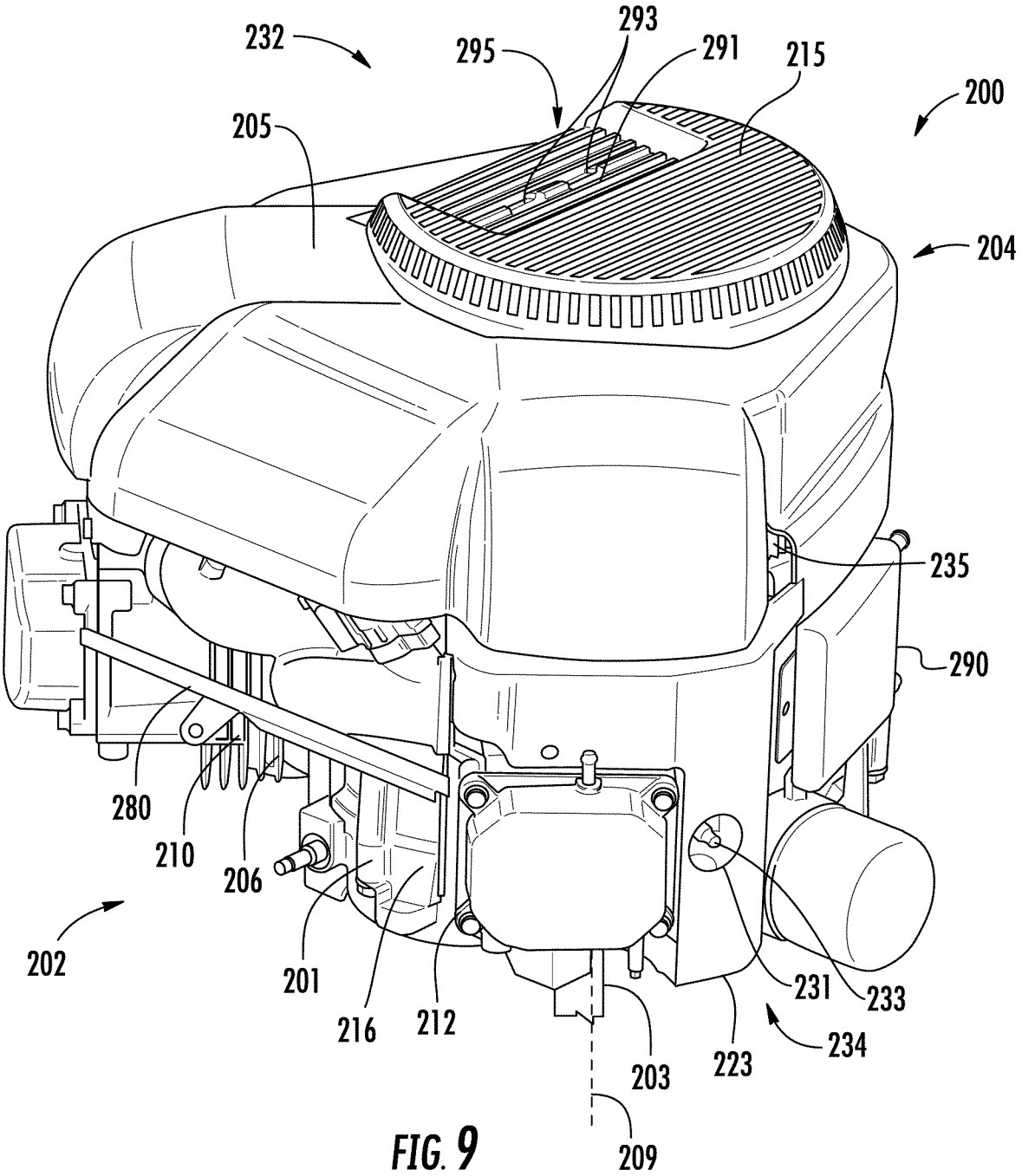
FIG. 9 is a front perspective view of an engine assembly, according to an exemplary embodiment.
Figure 10:
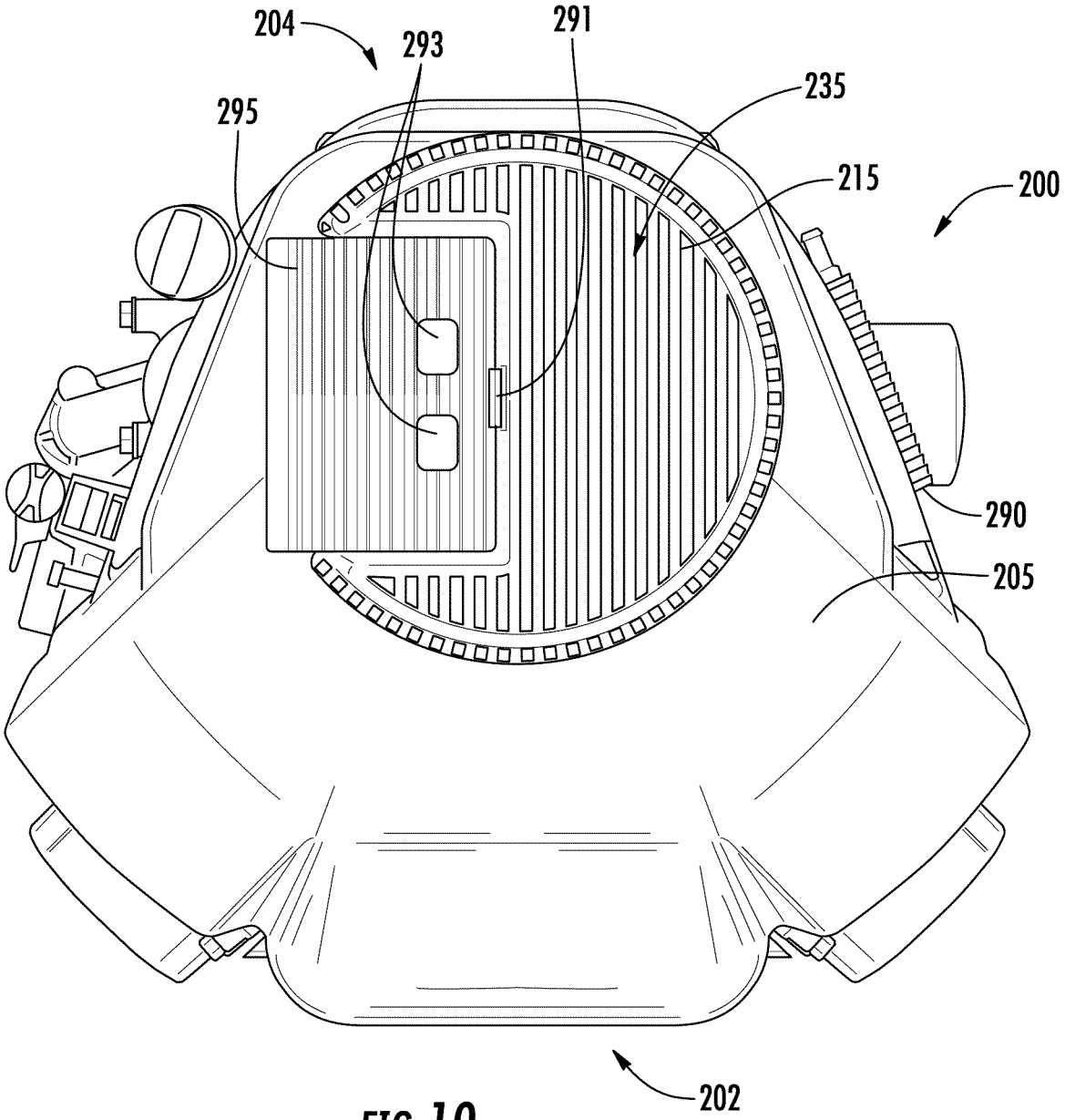
FIG. 10 is a top view of the engine assembly of FIG. 9.
Figure 11:
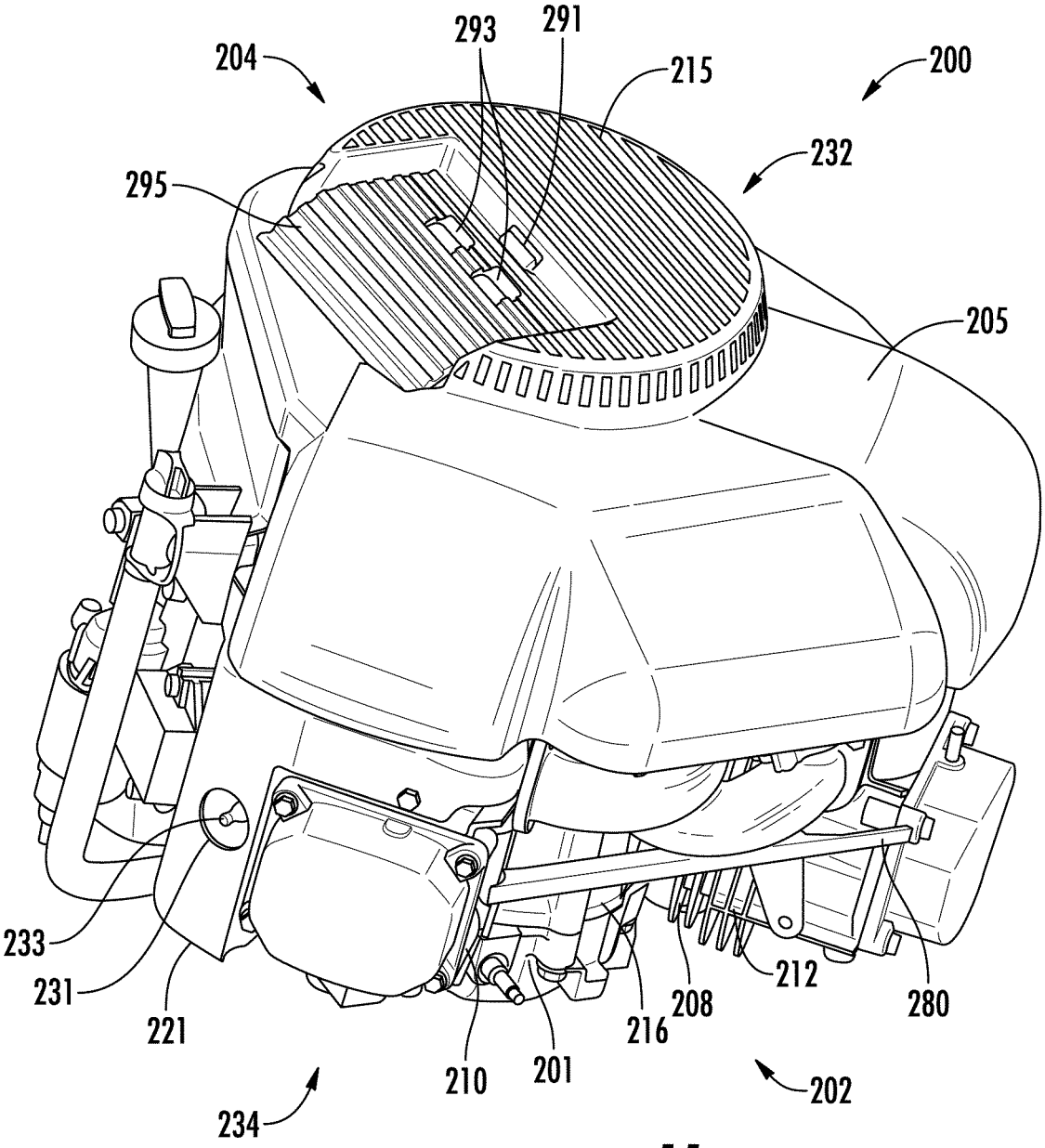
FIG. 11 is a front perspective view of the engine assembly of FIG. 9.

As shown in FIG. 9, the housing 205 of the engine 200 varies slightly from that shown in FIG. 5. The housing 205 includes a single screen 215 positioned proximate the rear 204 of the engine 200 and directly above the crankshaft 203, flywheel 235, air filter assembly 255, and throttle body 240.

Access to the air filter assembly 255 is provided through an access panel 295 formed in the screen 215. The access panel 295 includes a fastener 291 (e.g., snap fastener, quick-release mechanism) and two finger grips 293. In some embodiments, there may be a single finger grip. A user can disengage the fastener 291 by moving the fastener 291 toward the finger grips 293 to open the access panel 295. Once the access panel is open, the user can easily access the air filter assembly 255 to replace or maintain the filter element 257 therein. In an under-hood application (e.g., under the hood of outdoor power equipment, such as a tractor), there may be a cowl (e.g., formed as part of the equipment) over the cooling air intake to aid in directing cooling air to components of the engine 200.

Figure 12:
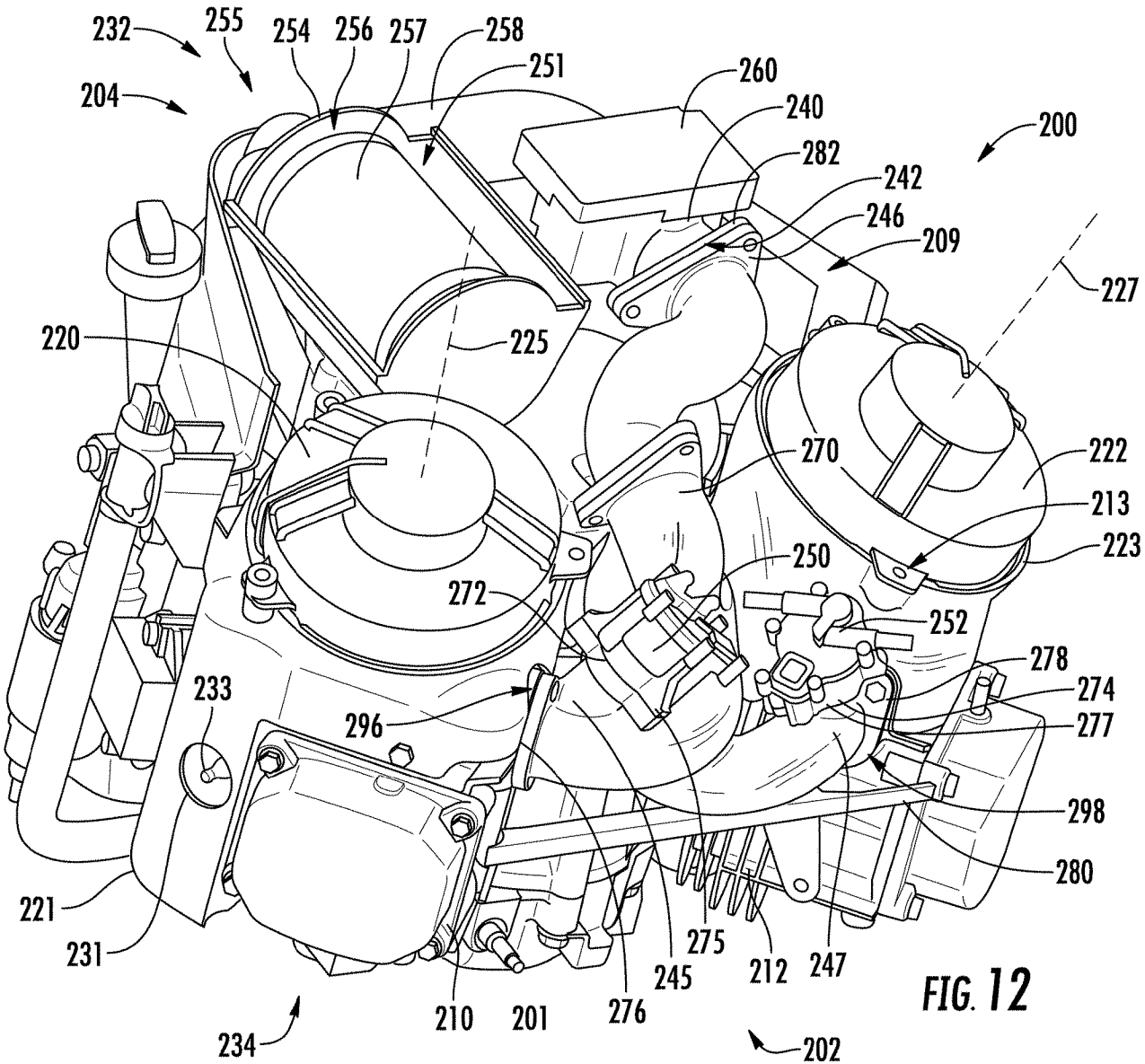
FIG. 12 is a front perspective view of the engine assembly of FIG. 9 with the housing removed.

Referring to FIG. 12, the air filter assembly 255 is configured to receive and filter ambient air from an external environment received through an air intake to remove particulates (e.g., dirt, pollen, etc.) from the air. Similar to air filter assembly 155, the air filter assembly 255 is configured to provide two stages of filtering of incoming air prior to supplying the filtered air to the engine 200 for combustion processes. The air filter assembly 255 includes a frame 254 including a receptacle 251 configured to receive the filter element 257. The filter element 257 is horizontally oriented with the engine 200 in its normal operating position. As shown, the crankshaft 203 of the engine 200 is vertically oriented and the air filter assembly 255 is horizontally oriented.

The air filter assembly 255 is positioned near the top 232 and the rear 204 of the engine 200 as shown in FIG. 12. The air filter assembly 255 is positioned proximate the throttle body 240 and approximately as close to the rear 204 of the engine 200 as the throttle body 240. The air filter assembly 255 is positioned above the flywheel 235. Accordingly, the filter element 257 is positioned directly above the flywheel 235. In addition, the air intake is positioned at the rear 204 of the engine 200 and opposite from the front 202 of the engine 200, where the cylinders 206, 208 and cylinder heads 210, 212 are positioned. In this way, the air intake is positioned away from (e.g., opposite from) the components of the engine 200 that typically would produce the most heat (e.g., cylinders 206, 208).

As shown in FIG. 6, the air filter assembly 255 is fluidly coupled to the throttle body 240 by a cleaned air conduit 258, such that the clean air may travel from the air filter assembly 255 to the throttle body 240. A filter outlet 256 is formed in the receptacle 251 and is configured to direct filtered air into the cleaned air conduit 258. The filter outlet 256 is positioned within and in fluid communication with the filtered volume of the filter element 257. The cleaned air conduit 258 includes a mounting flange for securing the cleaned air conduit 258 to an inlet port of the throttle body 240 (e.g., via bolts or other fasteners inserted through bolt holes). The cleaned air conduit 258 is positioned further toward the rear 204 of the engine 200 than the throttle body 240. This arrangement helps to provide a relatively compact air filter assembly 255 and throttle body 240 arrangement all positioned above the crankshaft 203 and flywheel 235 of the engine 200.

The internal combustion engine 300 includes an engine block 201 having two cylinders 306 and 308, two cylinder heads 310 and 312, two pistons, and a crankshaft 303. Each piston reciprocates in a cylinder along a cylinder axis to drive the crankshaft 303. The crankshaft 303 rotates about a crankshaft axis 307. The crankshaft 303 is positioned in part within a crankcase chamber defined by the engine block 301 and a sump or crankcase cover 316. The engine 300 also includes an electronic fuel system for supplying an air-fuel mixture to each cylinder (e.g., an electronic fuel injection system, a fuel direct injection system, etc.), an air filter assembly 355, a flywheel 335, and one or more electric fans 320, 322. The engine 300 includes a housing 305 configured to direct cooling air over the engine block 301 and other components of the engine. The electric fans 320, 322 pull air into the housing 305 through two screens 315. The illustrated engine 300 is a vertically-shafted two-cylinder engine arranged in a V-twin configuration.

The components of the engine 300 shown in FIGS. 13-17 are similar to the components of engine 100 shown in FIGS. 1-8 and engine 200 shown in FIGS. 9-12 and thus, similar reference numerals are used to refer each of the similar components. Many of the components shown in FIGS. 13-17 are also positioned on the engine 300 similar to the same components on engines 100, 200. The cylinders 306, 308, cylinder heads 310, 312, electric fans 320, 322, FDI units 350, 352, and intake manifold 370 are all positioned similarly to the similar components on engines 100, 200.

Figure 13:
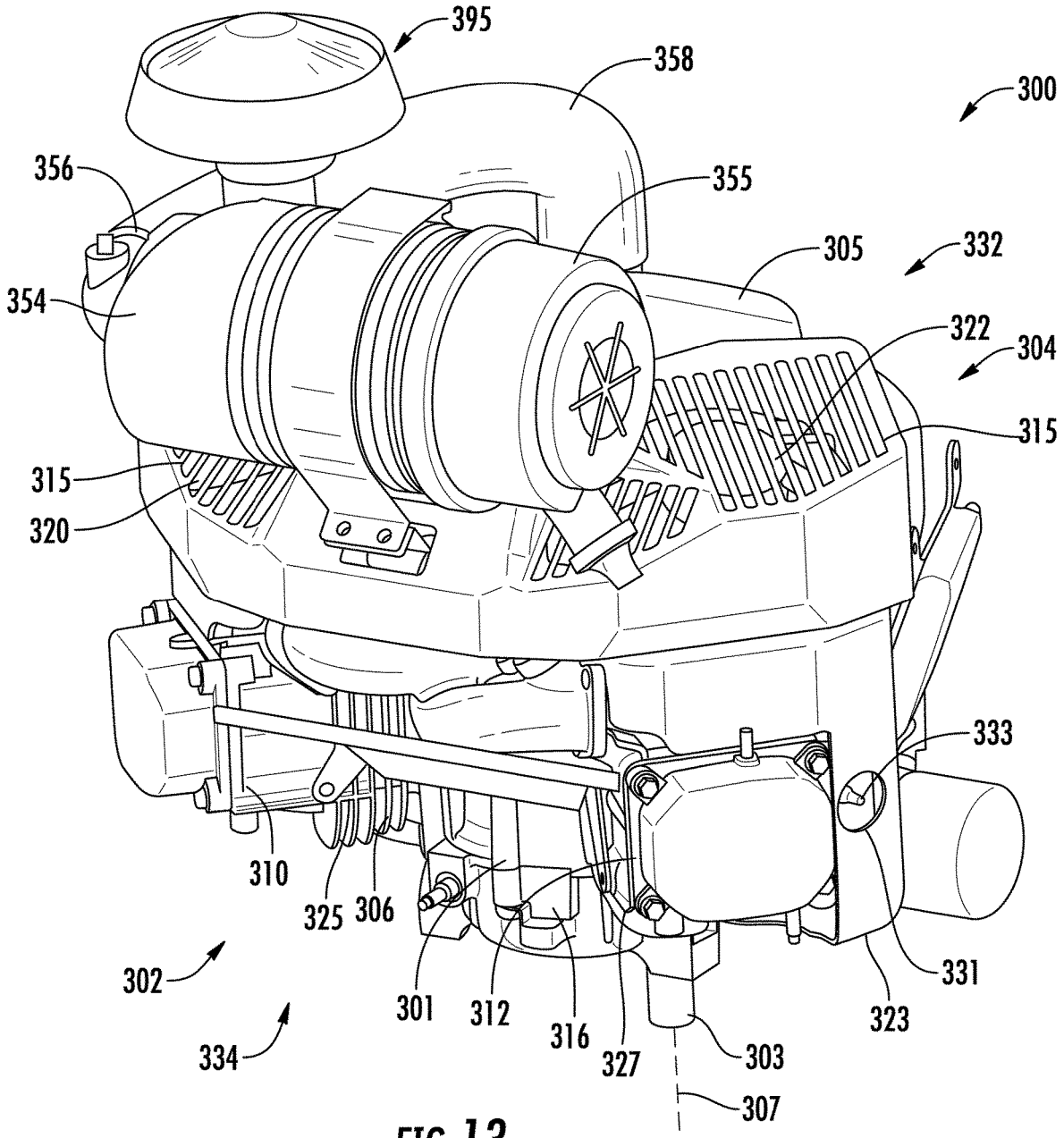
FIG. 13 is a front perspective view of an engine assembly, according to an exemplary embodiment.
Figure 14:
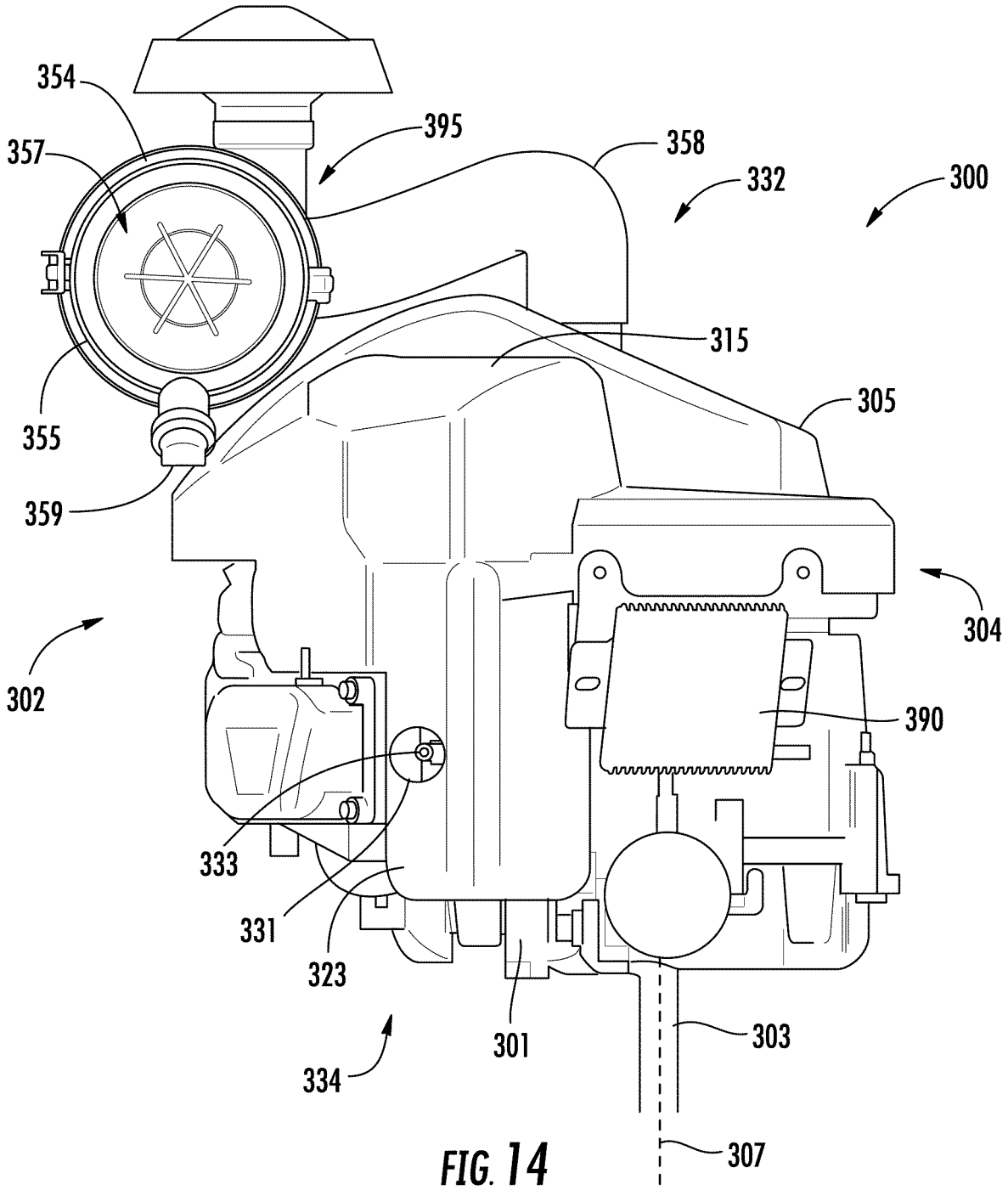
FIG. 14 is a side view of the engine assembly of FIG. 13.
Figure 15:
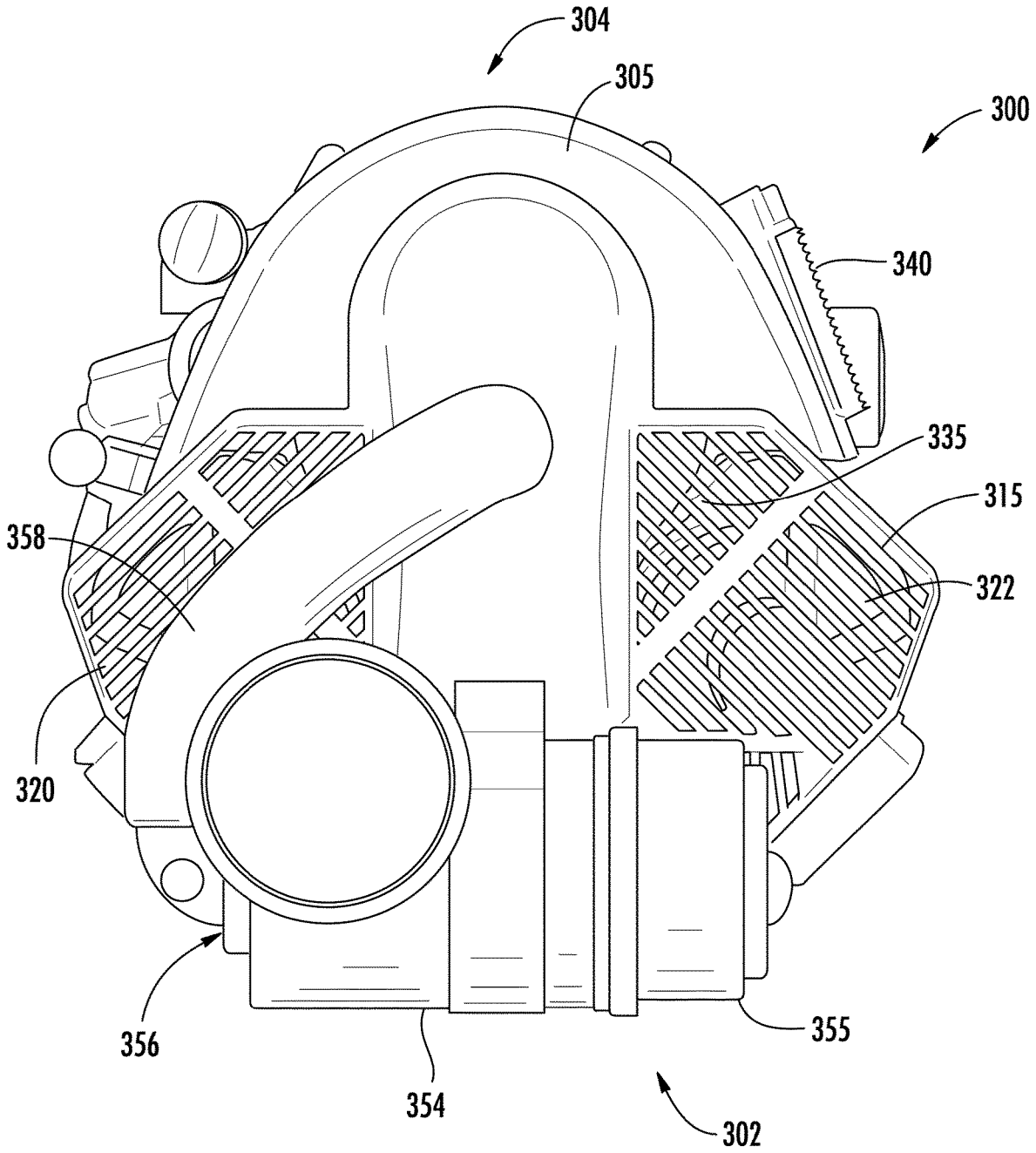
FIG. 15 is a top view of the engine assembly of FIG. 13.
Figure 16:
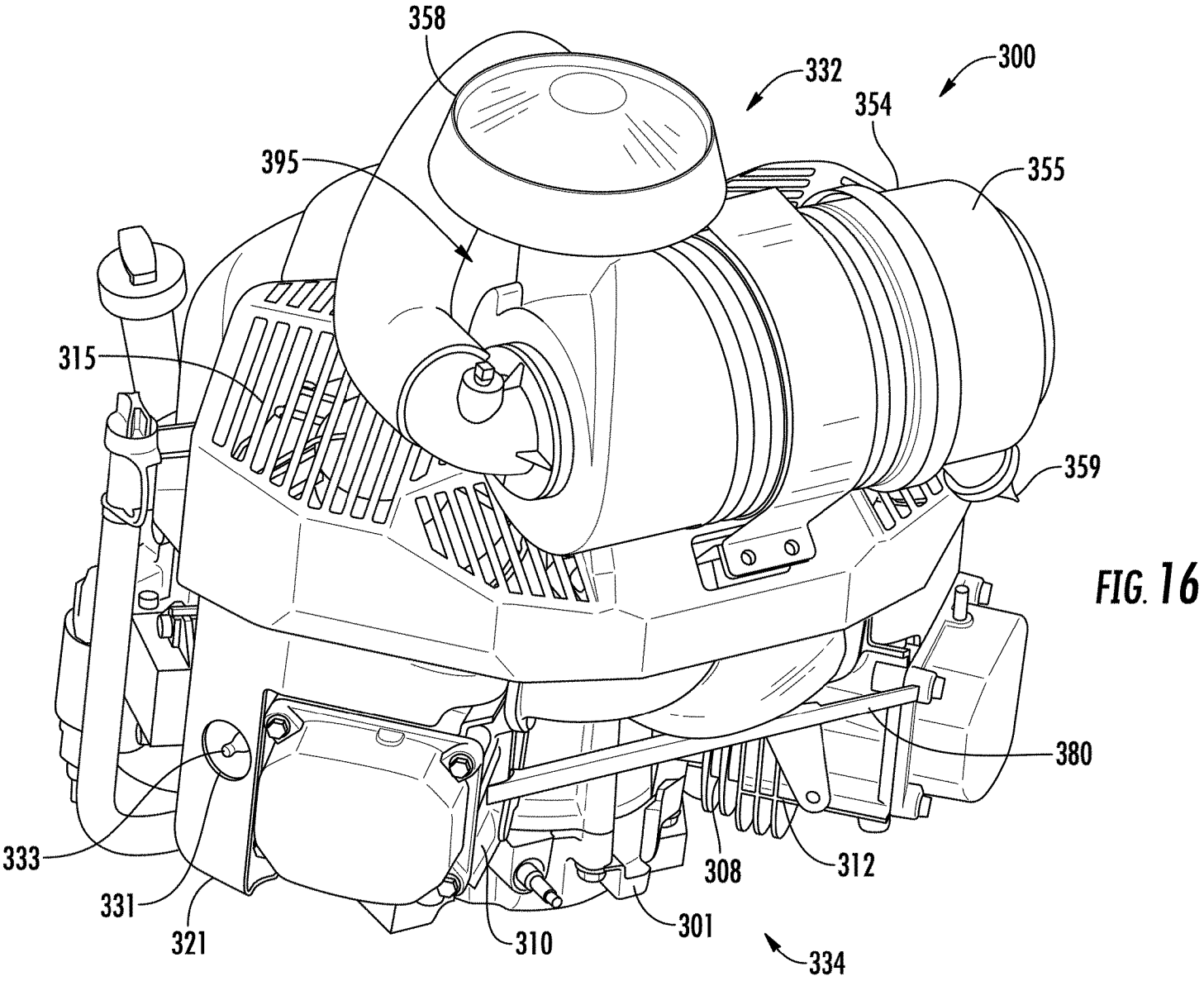
FIG. 16 is a front perspective view of the engine assembly of FIG. 13.
Figure 17:
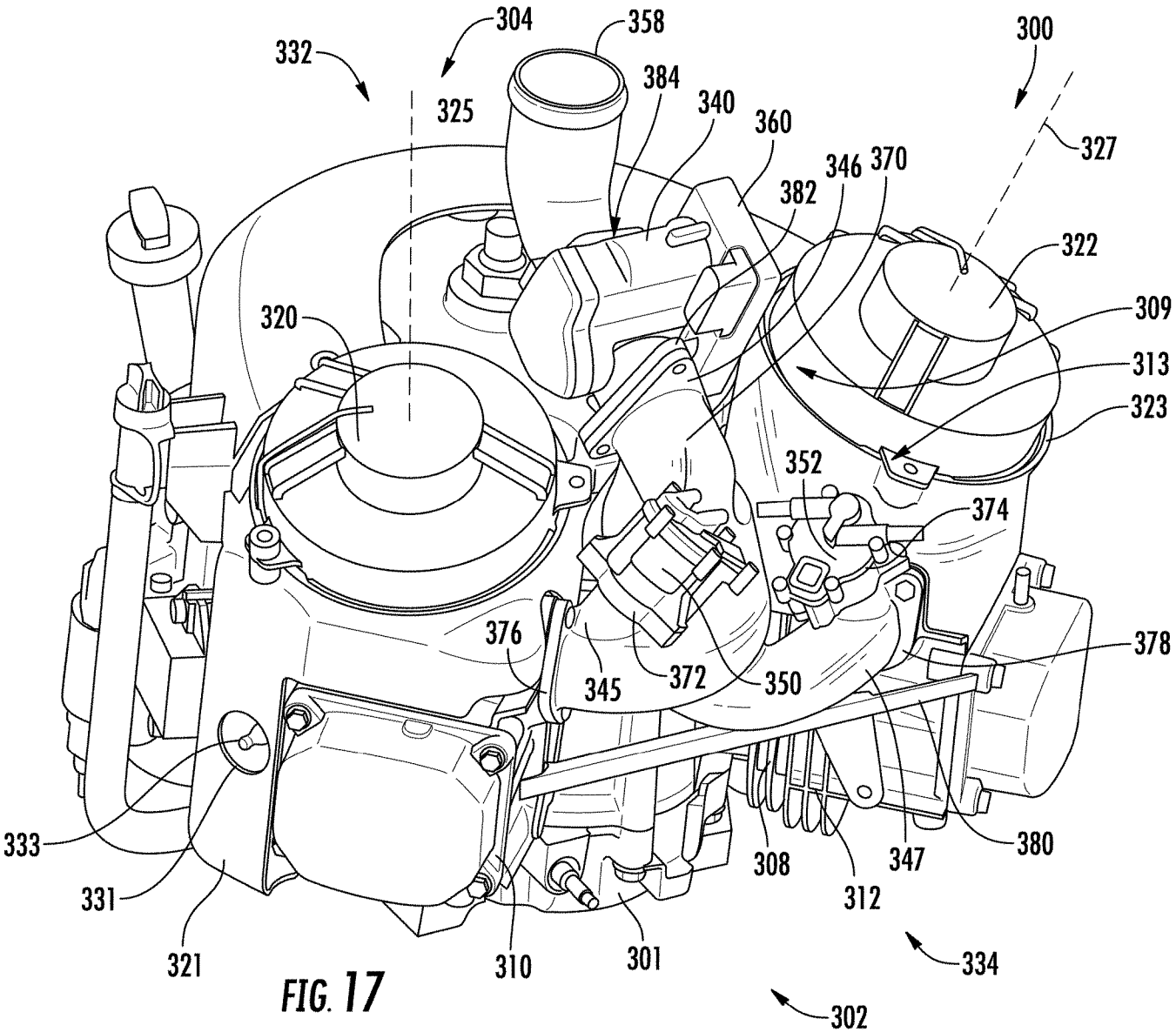
FIG. 17 is a front perspective view of the engine assembly of FIG. 13 with the housing removed.

As shown in FIG. 13, the air filter assembly 355 is positioned remotely from the rest of the engine 300. Thus, the air filter assembly 355 is not positioned within the housing 305 and instead includes a separate filter housing 354 configured to receive and house a filter element 357 (shown in FIG. 14. The air filter assembly 355 is configured to receive and filter ambient air from an external environment received through an air intake 395 to remove particulates (e.g., dirt, pollen, etc.) from the air. Similar to air filter assemblies 155, 255, the air filter assembly 355 is configured to provide two stages of filtering of incoming air prior to supplying the filtered air to the engine 300 for combustion processes. The filter element 357 is horizontally oriented with the engine 300 in its normal operating position. As shown, the crankshaft 303 of the engine 300 is vertically oriented and the air filter assembly 355 is horizontally oriented. The air filter assembly 355 is positioned above the top 332 of the engine 300 and proximate the front 302 of the engine 300 as shown in FIGS. 13-15. As such, the air intake 395 is positioned away from the rest of the engine 300, thus reducing the exposure to hot temperatures.

The air filter assembly 355 is fluidly coupled to the throttle body 340 (FIG. 17) by a cleaned air conduit 358, such that the clean air may travel from the air filter assembly 355 to the throttle body 340. A filter outlet 356 is formed in the filter housing 354 and is configured to direct filtered air into the cleaned air conduit 358. The filter outlet 356 is positioned within and in fluid communication with the filtered volume of the filter element 357. The cleaned air conduit 358 includes a mounting flange for securing the cleaned air conduit 358 to an inlet port 384 of the throttle body 340 (e.g., via bolts or other fasteners inserted through bolt holes). The cleaned air conduit 358 extends from the filter housing 354 and through the housing 305 to the throttle body 340.

Referring now to FIGS. 18-24, an engine assembly including an internal combustion engine 400 is illustrated according to an exemplary embodiment. The internal combustion engine 400 includes an engine block 401 having two cylinders 406 and 408, two cylinder heads 410 and 412, two pistons, and a crankshaft 403. Each piston reciprocates in a cylinder along a cylinder axis to drive the crankshaft 403. The crankshaft 403 rotates about a crankshaft axis 407. The crankshaft 403 is positioned in part within a crankcase chamber defined by the engine block 401 and a sump or crankcase cover 416. The engine 400 also includes an electronic fuel system for supplying an air-fuel mixture to each cylinder (e.g., an EFI system, a fuel direct injection system, an electronic governor, etc.), an air filter assembly 455, a flywheel 435, and one or more electric fans 420, 422. The engine 400 includes a housing 405 configured to direct cooling air over the engine block 401 and other components of the engine. The illustrated engine 400 is a vertically-shafted two-cylinder engine arranged in a V-twin configuration.

The components of the engine 400 shown in FIGS. 18-24 are similar to the components of engine 100 shown in FIGS. 1-8 and thus, similar reference numerals are used to refer each of the similar components. Many of the components shown in FIGS. 18-24 are also positioned on the engine 400 similar to the same components on engine 100. The cylinders 406, 408, cylinder heads 410, 412, FDI units 450, 452, and intake manifold 470 are all positioned similarly to the similar components on engine 100.

As shown in FIGS. 18-20 and 25, the housing 405 of the engine 400 varies slightly from that shown in FIG. 5. The housing 405 includes a single screen portion 418 having a screen 415 positioned proximate the rear 404 of the engine 400 and directly above the crankshaft 403 and the flywheel 435. The screen 415 allows air to ventilate due to the rotation of the flywheel 435. As the flywheel 435 rotates, it produces a large amount of air movement circulating the air inside the housing 405 and outside the housing 405 through the screen 415. The air filter assembly 455 is located off to the side and proximate the rear 404 and top 432 of the engine 400. In some embodiments, the battery 465 is also located off to the side and proximate the rear 404 and top 432 of the engine, but on an opposite side of the engine 400 from the air filter assembly 455. As shown, the air filter assembly 455 is located substantially (e.g., proximate, next to) the flywheel 435. In some embodiments, the housing 405 includes a battery cover portion 466 that is integrated with the rest of the housing 405. The battery cover portion 466 at least partially covers or houses the battery 465 therein.

Figure 18:
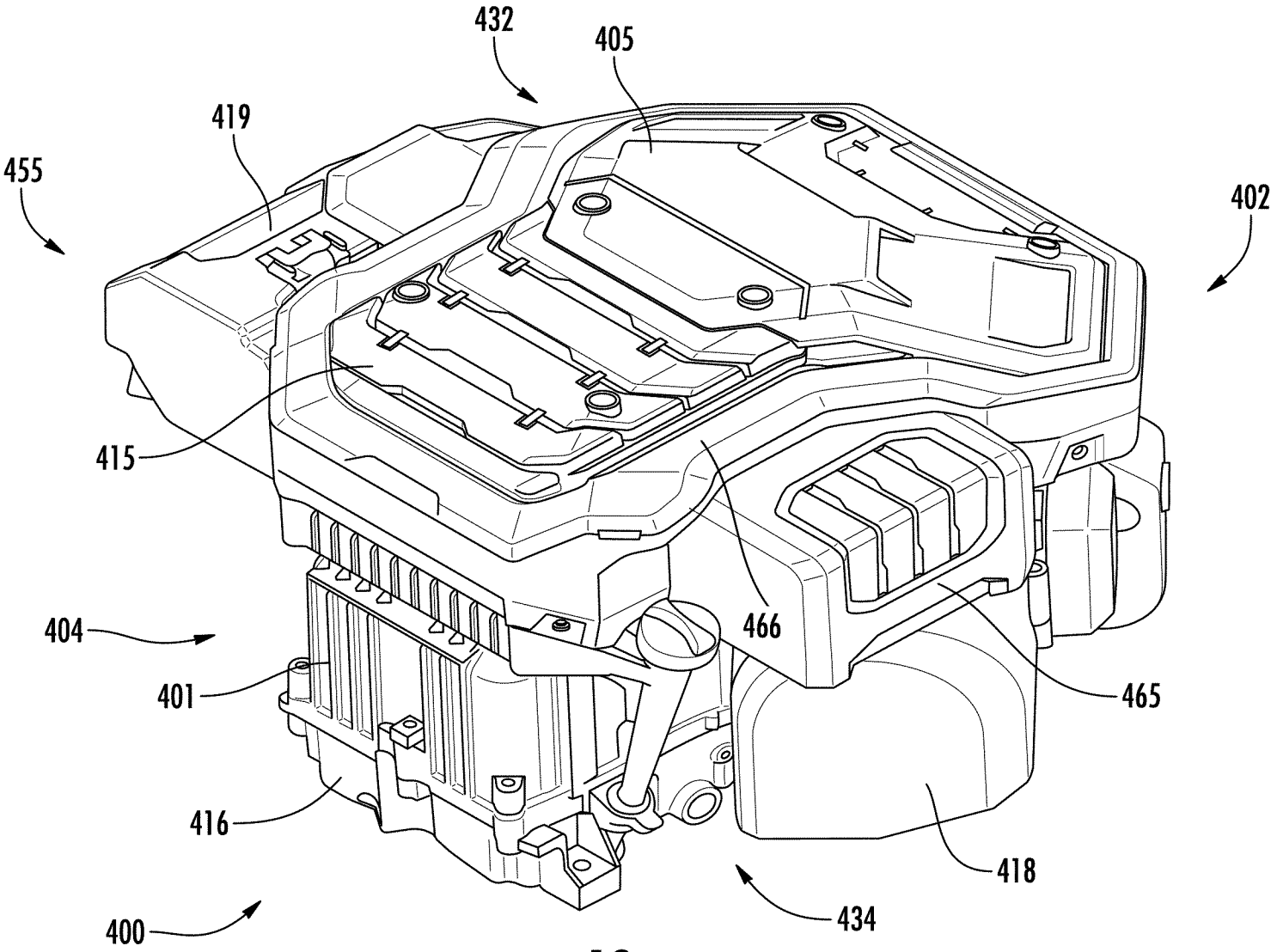
FIG. 18 is a rear perspective view of an engine assembly, according to an exemplary embodiment.
Figure 19:
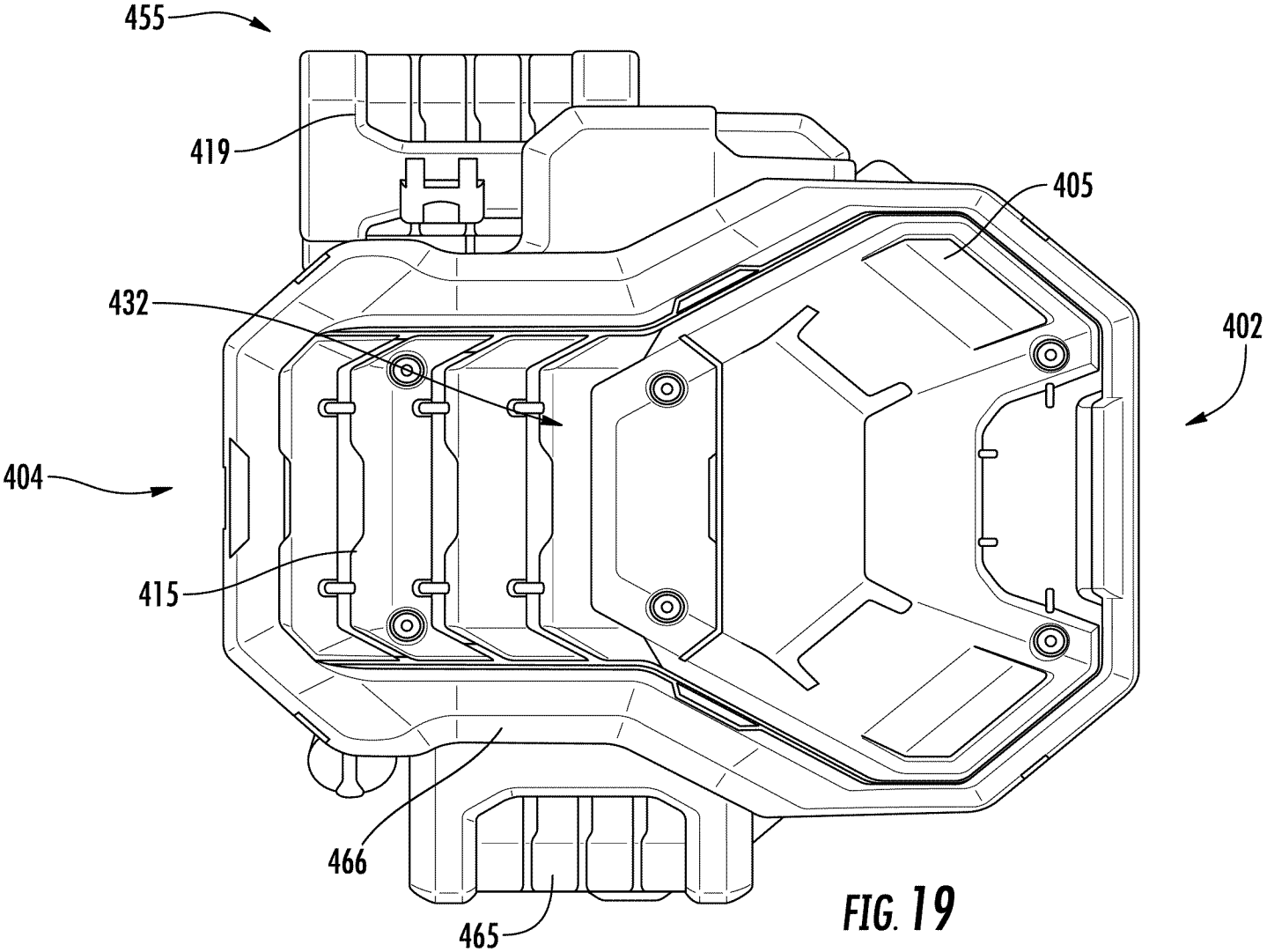
FIG. 19 is a top view of the engine assembly of FIG. 18.
Figure 20:
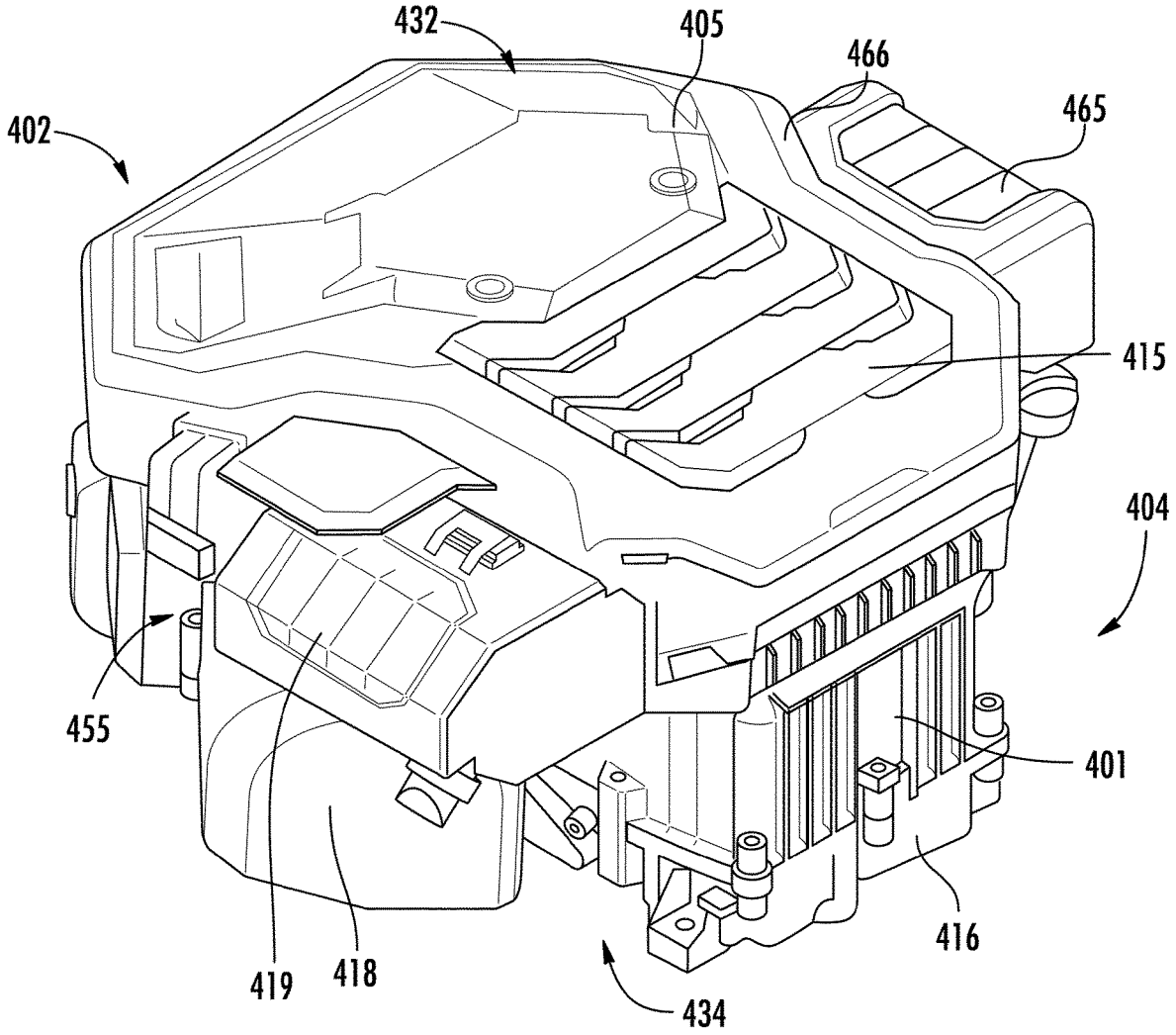
FIG. 20 is a second rear perspective view of the engine assembly of FIG. 18.
Figure 21:
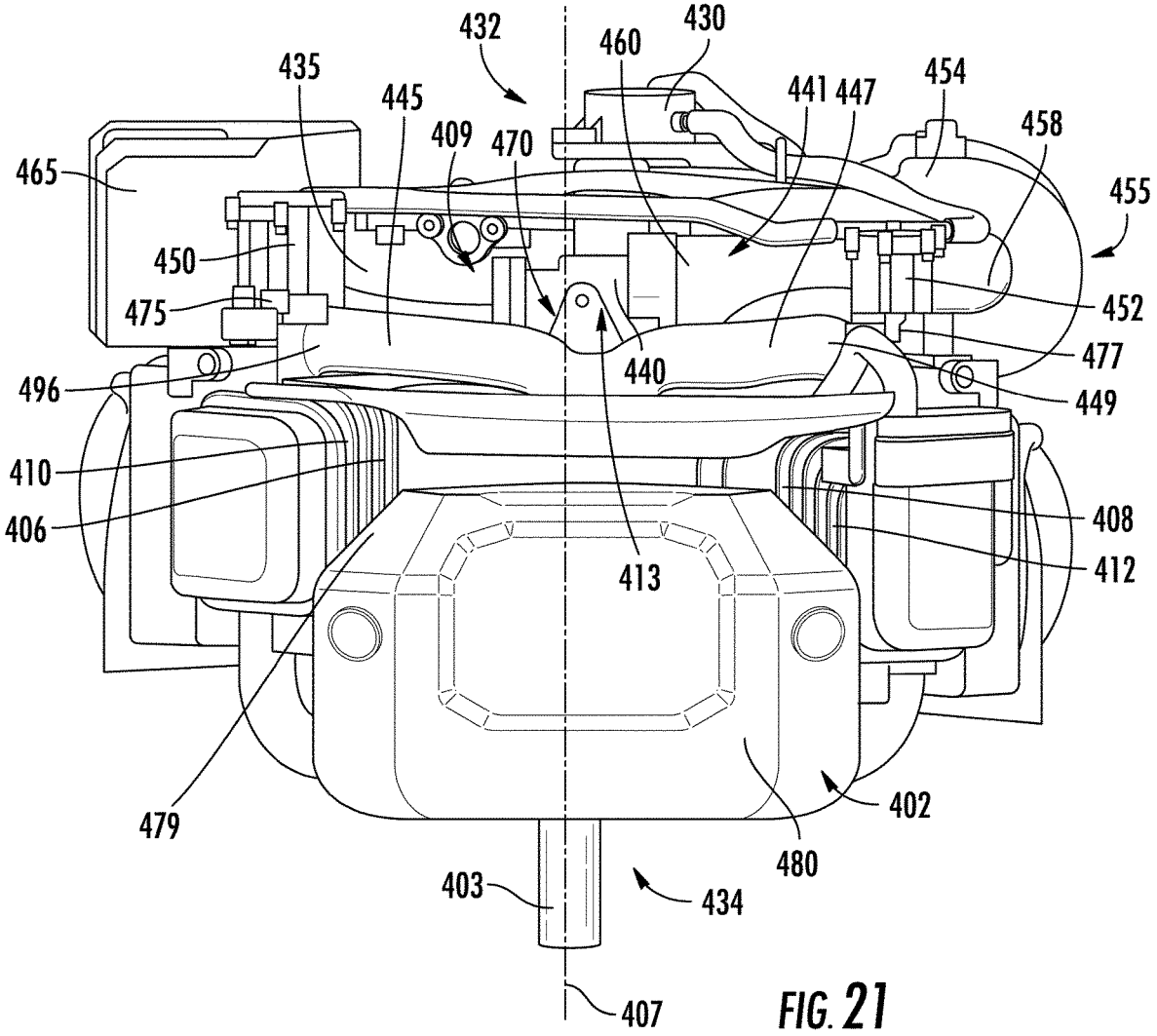
FIG. 21 is a front view of the engine assembly of FIG. 18 with the housing removed.

Still referring to FIGS. 18-20, the engine 400 further includes an energy storage device, such as a battery 465 (e.g., a lithium-ion battery, a lead acid battery, a capacitor, multiple batteries or capacitors, or other suitable energy storage devices). The battery 465 is located on an opposite side of the engine 400 from the air filter assembly 455 and proximate the rear 404 and top 432 of the engine 400. As such, the battery 465 is positioned within the overall footprint of the engine 400. The battery 465 may include one or more battery cells (e.g., lithium-ion cells). The battery 465 is electrically coupled to the alternator 414 and a starter of the engine 400. The battery 465 is charged by the alternator 414 and powers the starter. In some embodiments, the battery 465 may be further configured to power other systems of the engine 400, such as an electronic control having control circuitry coupled to sensors or detectors integrated with the engine 400 (e.g., brake release, fuel-level detector, ignition-fouling detector, governor, vacuum sensors, pressure sensors, temperature sensors). In further embodiments, the battery 465 is electrically coupled to the controller 411 (similar to the controller 111) to power various systems of the engine 400. For example, the controller 411 controls operation of the engine 400 including the EFI system 413 and the electronic governor system 441. In some embodiments, the controller 411 also controls the operation of the electrical fans 420, 422. The battery 465, which is electrically coupled to the controller 411, may also be electrically coupled to various other components (e.g., the EFI system 413, the electronic governor system 441, the electrical fans 420, 422) to control operation. Because the battery 465 is located proximate the top 432, the engine 400 requires less material (e.g., wire, conduit, circuits) to connect the battery 465 to the alternator 414 and the controller 411.

Figure 22:
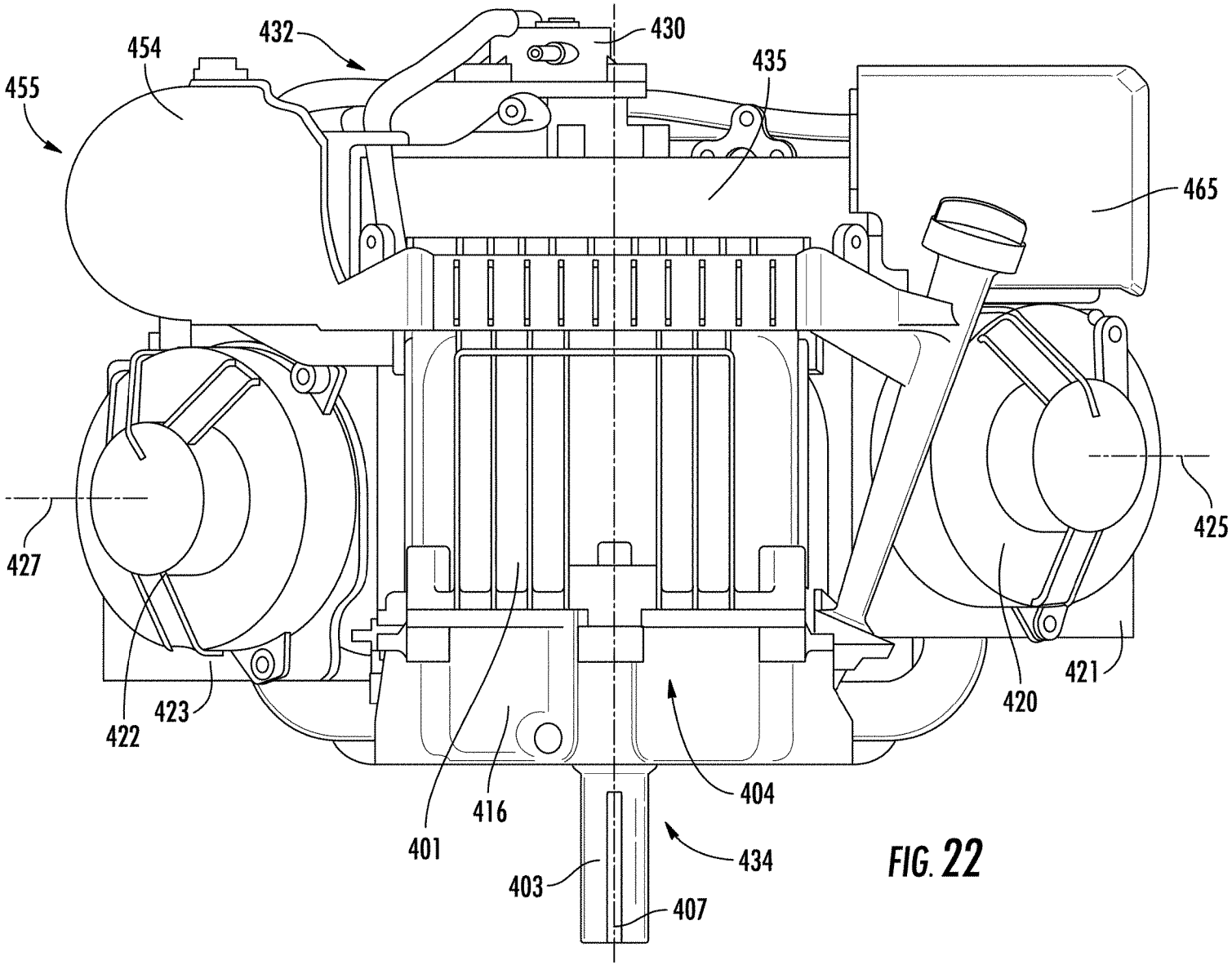
FIG. 22 is a rear view of the engine assembly of FIG. 18 with the housing removed.

As shown in FIGS. 21-24, the engine 400 includes the electric fans 420, 422. The electric fans 420, 422 are located between the top 432 and the bottom 434 and the front 402 and the back 404, (e.g., towards the middle of the engine 400). The electric fans 420, 422 are covered by protective covers 418. The protective covers 418 include an opening approximate the bottom 434 that allows air to enter the covers 418. The protective covers 418 both protect the electric fans 420, 422 from large debris (e.g., rocks) and prevent a user from putting their hand in the electric fans 420, 422. The electric fans 420, 422 are configured to pull air axially (e.g., axially through the fans 420, 422) onto the first cylinder 406 and the second cylinder 408. The first electric fan 420 is thus positioned substantially adjacent (e.g., proximate, next to) the first cylinder 406 and first cylinder head 410 and the second electric fan 422 is positioned substantially adjacent the second cylinder 408 and second cylinder head 412. In further embodiments, the first electric fan 420 is positioned directly adjacent the first cylinder 406 and first cylinder head 410. In even other embodiments, the second electric fan 422 is directly adjacent the second cylinder 408 and the second cylinder head 412. The electric fans 420, 422 do not need to be placed directly above the crankshaft, as the rotation of fan blades is not related to the rotation of the crankshaft 403 (i.e., the axes of rotation 425, 427 need not be collinear or parallel with the axis of rotation 407 of the crankshaft 403). In some embodiments, the electric fans 420, 422 rotate about axes of rotation 425, 427 that are substantially perpendicular to the axis of rotation 407 of the crankshaft 403 (e.g., ranging from 80 degrees to 100 degrees relative to the axis of rotation 407). As shown in FIG. 22, the first electric fan 420 and the first cylinder 406 are at least partially positioned within a first ducting portion 421. The second electric fan 422 and the second cylinder 408 are at least partially positioned with a second ducting portion 423. The protective cover 418 and first ducting portion 421 direct incoming air flow directly over the first cylinder 406 and first cylinder head 410 thereby increasing heat transfer from the first cylinder 406 and first cylinder head 410.

Figure 23:
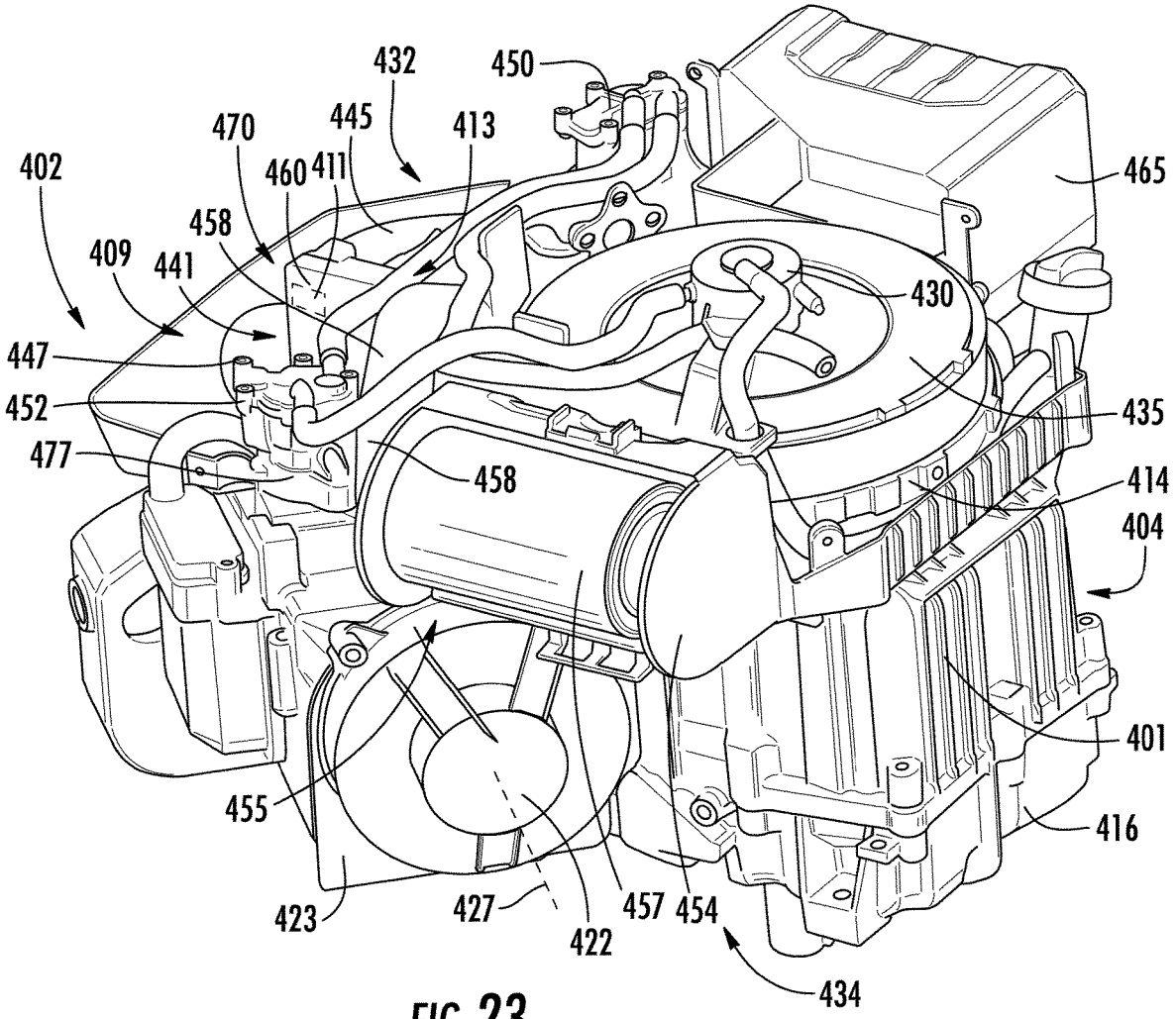
FIG. 23 is a side perspective view of the engine assembly of FIG. 18 with the housing removed.
Figure 24:
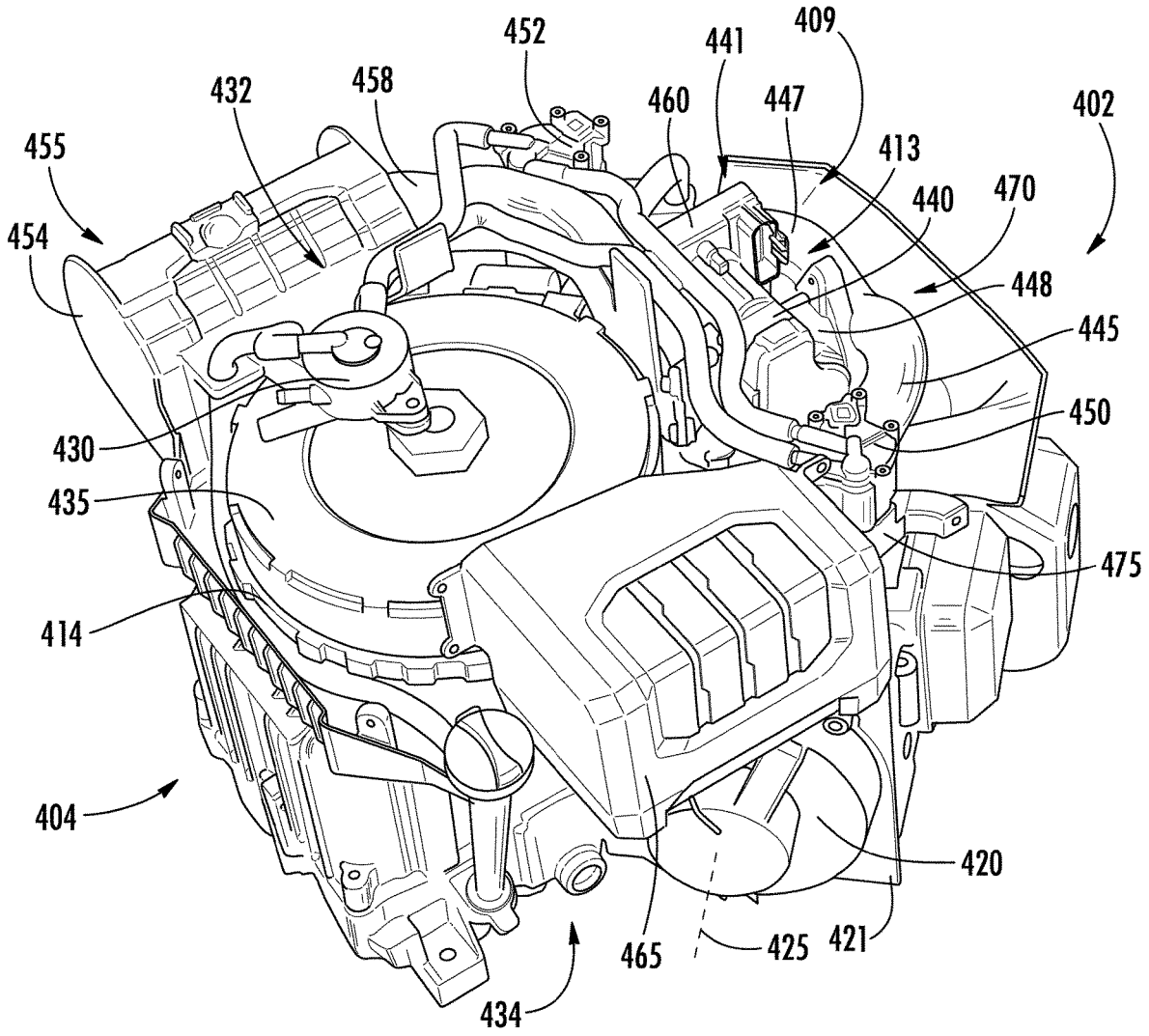
FIG. 24 is a top perspective view of the engine assembly of FIG. 18 with the housing removed.
Figure 25:
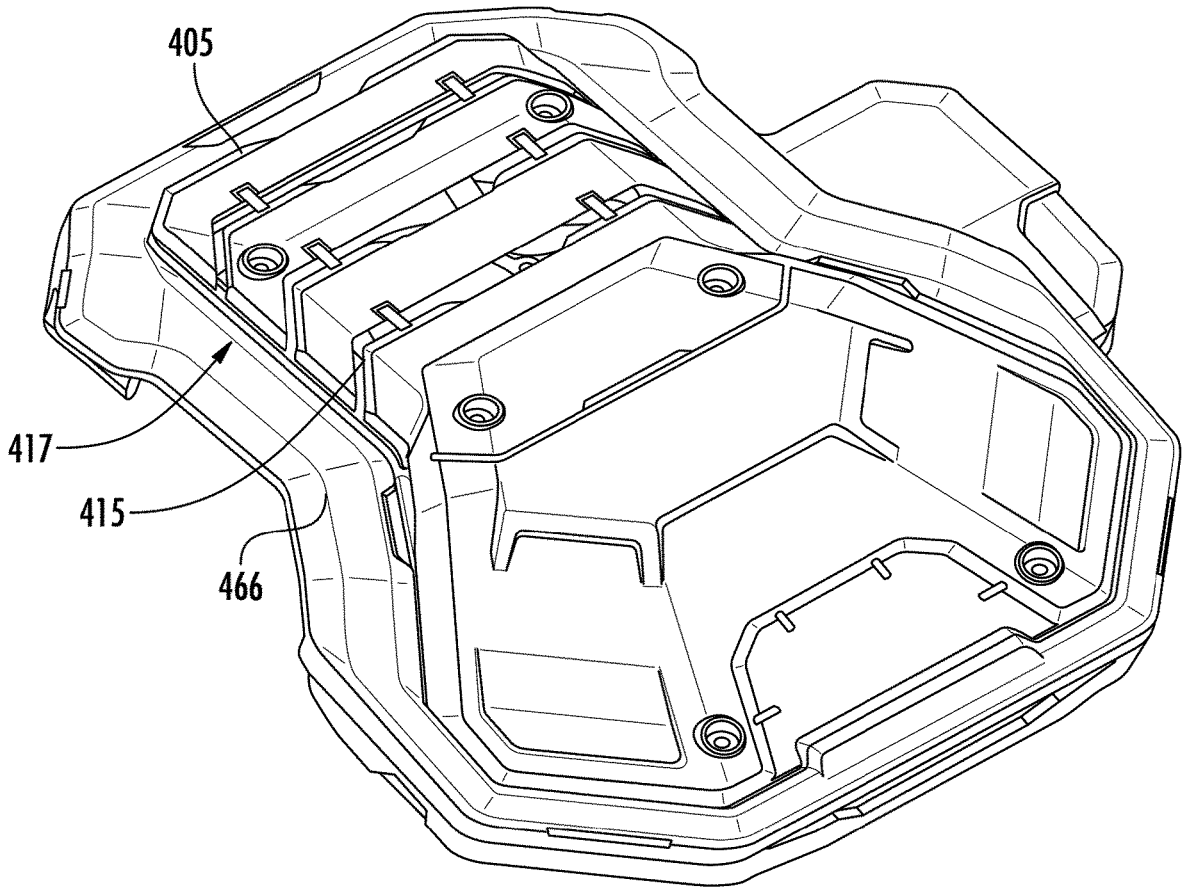
FIG. 25 is a perspective view of a housing of the engine assembly of FIG. 18.

As shown in FIG. 23, the air filter assembly 455 includes a frame 454 and a filter element 457. The air filter assembly 455 is configured to provide two stages of filtering of incoming air prior to supplying the filtered air to the engine 400 for combustion processes. The first filtering stage includes cyclonic filtering of incoming air through the air filter assembly 455. The cyclonic filtering is configured to remove large particles of debris prior to secondary filtering of the air. The second filtering stage includes filtering of the partially filtered air through the filter element 457 to remove smaller particles of debris from the incoming air. The filtered air is then sent to the throttle body 440 and then the intake manifold 470 of the engine 400 to be mixed with fuel prior to combustion in each cylinder 406, 408 of the engine 400. The intake manifold 470 is similar to the intake manifold 170, and thus similar reference numerals are used for components of each. The filter element 457 is horizontally oriented with the engine 400 in its normal operating position. As shown, the crankshaft 403 of the engine 400 is vertically oriented and the air filter assembly 455 is horizontally oriented. In further embodiments, the air filter assembly 455 includes two filter elements (similar to the engine 100). The air filter assembly 455 fits within the overall footprint of the engine 400.

As discussed above, the overall engine 400 package size is more compact than a typical V-twin engine due to the incorporation of the electronic fuel system. This is, in part, due to the elimination of a carburetor, mechanical governor, and mechanical linkages, which reduces the amount of space that the electronic fuel system takes up and where the components can be located. As a result, the engine 400 incorporates a muffler 480 (FIG. 21) within some of the reclaimed space (e.g., in a valley or space between the two cylinders). The muffler 480 provides noise dampening properties to the exhaust of the engine 400 while still saving on overall space. The muffler 480 includes an angled portion 479 that fits between the "V" of the engine 400 (e.g., between the first cylinder 406, the first cylinder head 410, the second cylinder 408, and the second cylinder head 412). As shown, the muffler 480 is located proximate the front 402 and bottom 434 of the engine 400 between the first cylinder head 410 and the second cylinder head 412). As the muffler 480 is more compact, the muffler 480 fits within the overall footprint of the engine 400. In further embodiments, the muffler 480 partially fits within the overall footprint of the engine 400, extending from the engine 400 footprint by a small margin (e.g., 1 inch).

Figure 26:
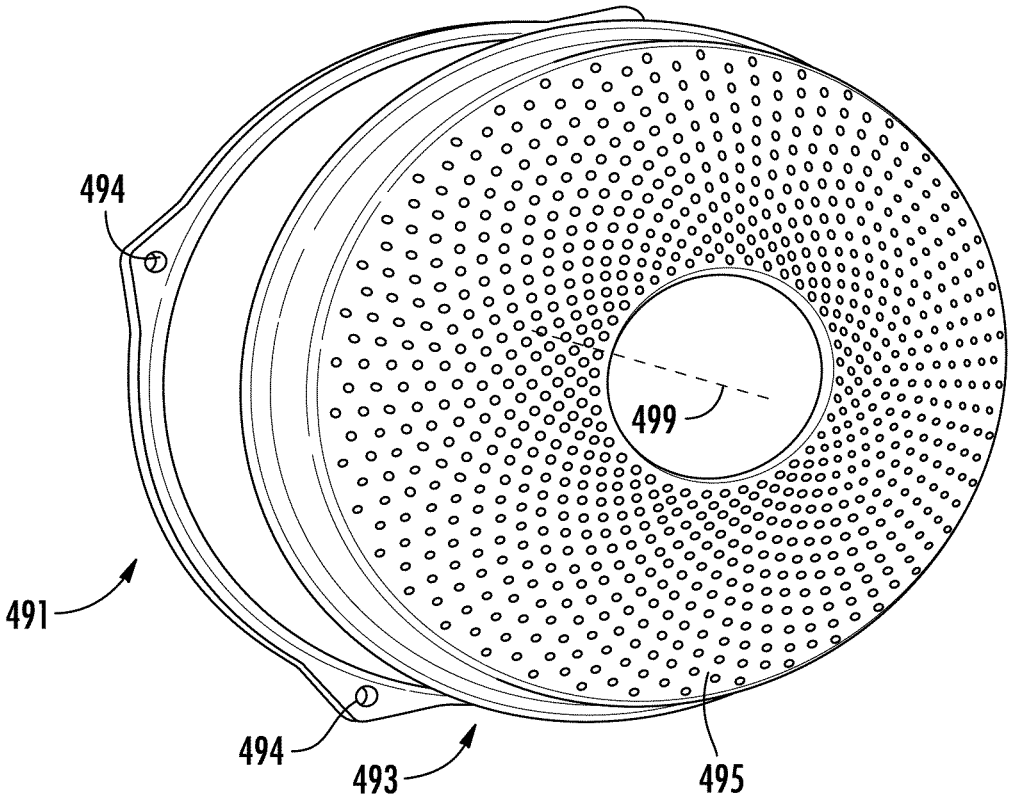
FIG. 26 is a perspective view of an electric fan assembly that may be implemented within the engine assembly of FIG. 18.
Figure 27:
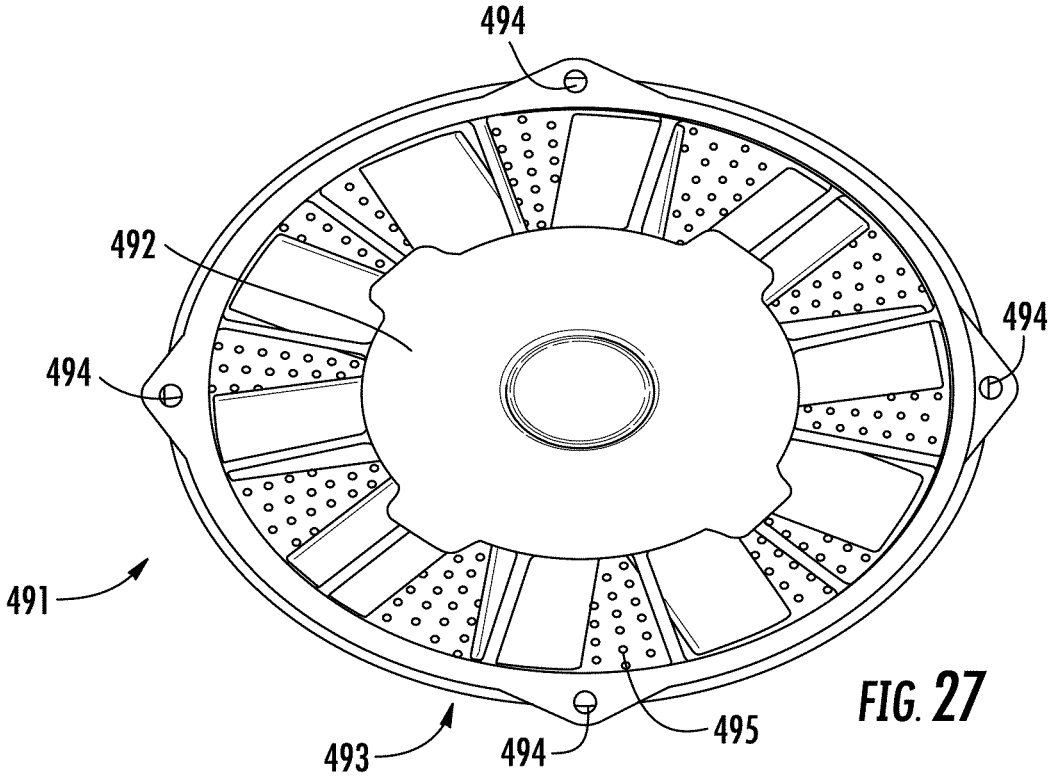
FIG. 27 is a rear view of an electric fan assembly that may be implemented within the engine assembly of FIG. 18.
Figure 28:
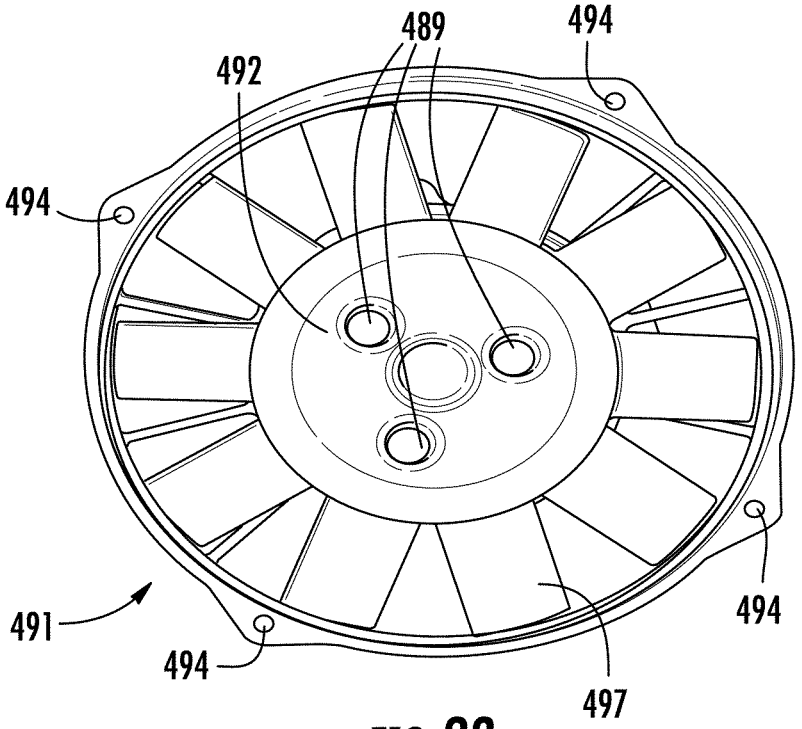
FIG. 28 is a front view of an electric fan assembly that may be implemented within the engine assembly of FIG. 18 with the fan cover removed.

Referring now to FIGS. 26-28 an electric fan assembly 491 is shown according to an exemplary embodiment. The electric fan assembly 491 includes a fan cover 493 and an electric fan 492. The electric fan 492 is similar to the first electric fan 420 and the second electric fan 422 and can be used in place of either on the engine 400. The electric fan includes one or more fan blades 497. The electric fan 492 includes a motor electrically connected to the alternator to receive electrical power. The electric fans 492 and/or the motor may also be electrically connected to the controller 411 to receive control signals to control operation of the electric fan 492. The electric motor rotates the fan blades 497 of about a fan axis 499. According to an exemplary embodiment, the fans are propeller-type fans that create a moving column of air parallel to the axis 499. The fan cover 493 is a cover similar to protective cover 418 and is structured to cover the fan blades 498. The fan cover 493 further includes a screen 495 that allows air to be pulled axially by the electric fan 492. The fan cover 493 is independent of the housing 405, and is coupled to the fan 492. The electric fan 492 is coupled to the screen 495 (e.g., mechanically coupled) such that the screen 495 moves with the electric fan 492 and the resulting centrifugal forces act to disperse any debris that may be on the screen 495. The electric fan 492 includes an electric motor. The electric motor may be included within a protective housing. The protective housing sealing the electric motor from water and other potentially hazardous contaminants. As shown in FIG. 28, the electric fan 492 is mechanically coupled to the screen 495 and therefore the fan cover 493 through one or more coupling bosses 489. The coupling bosses 489 each receive a fastener (e.g., a bolt) to couple the electric fan 492 to the screen 495.

The electric fan 492 is to be positioned substantially adjacent (e.g., proximate, next to) to at least one of the first cylinder 406 and first cylinder head 410 and the second cylinder 408 and second cylinder head 412. The electric fan 492 is at least partially positioned within at least one of the first ducting portion 421 and the second ducting portion 423. The fan assembly 491 couples to at least one of the first ducting portion 421 and the second ducting portion 423 through multiple mounting flanges 494. In some embodiments, the mounting flanges 494 couple to at least one of the first ducting portion 421 and the second ducting portion 423 through fasteners. In further embodiments, when the flanges 494 couple to at least one of the first ducting portion 421 and the second ducting portion 423, an air tight seal is created. FIG. 28 shows the fan with the fan cover 493 removed.

Figure 29:
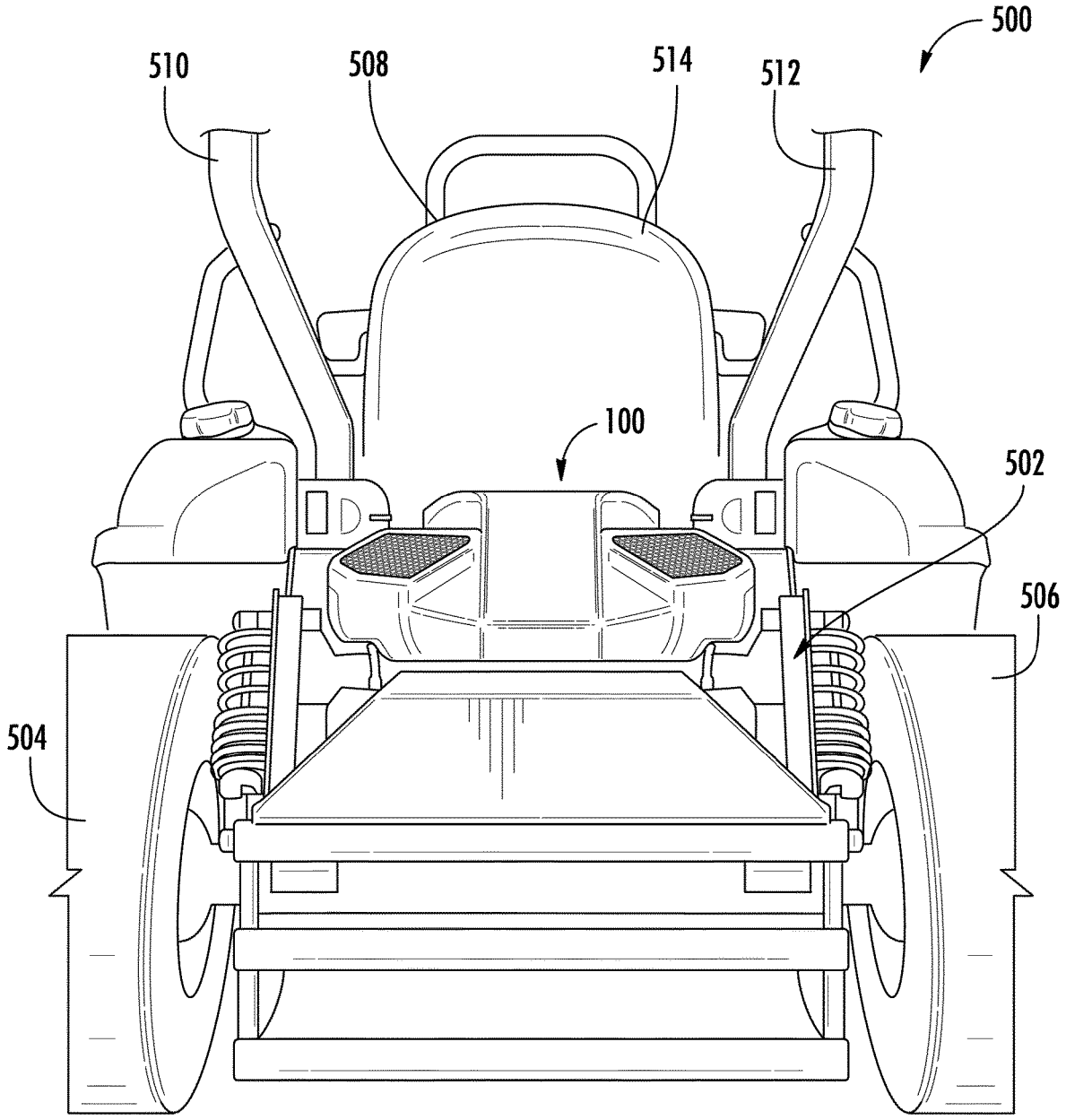
FIG. 29 is a rear view of a portion of a lawn mower including the engine assembly of FIG. 1.
Figure 30:
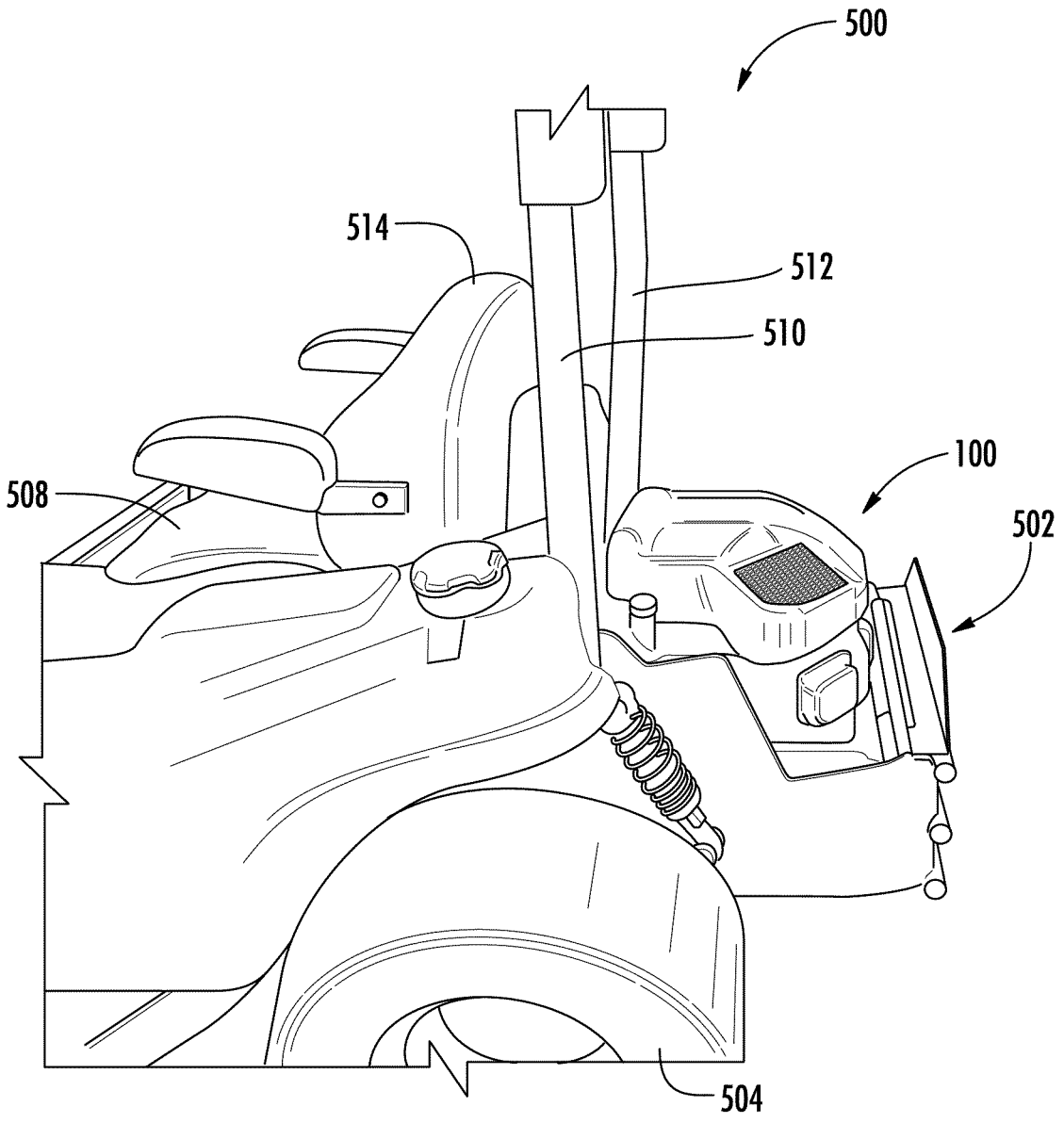
FIG. 30 is a side view of a portion of a lawn mower including the engine assembly of FIG. 1.

FIGS. 29-30 illustrate the engine 100 in use on a zero-turn lawn mower 500. In other embodiments, the engine 100 is used with other types of outdoor power equipment, including other types of riding outdoor power equipment. The engine 100 is located on a mounting platform 502 located between the two rear wheels 504 and 506 and behind the user location 508, illustrated as a seat. The engine 100 is also located between the vertical legs 510 and 512 of a roll bar for protecting the user. The uppermost point of the engine 100 is located well below the top of the back 514 of the operator seat 508. The overall compact package size of the engine 100 allows the engine 100 to be positioned entirely within the walls of the mounting platform 502, within the vertical legs 510, 512 of the roll bar, and well below the top of the back 514 of the operator seat 508. The relatively low positioning of the engine 100 within the mounting platform 502 protects the components of the engine 100 positioned on the outside of the housing 105 and engine block 101 from external elements that may come into contact with the engine 100. In addition, as described above, the positioning of the majority of the engine components within the housing 105 protects those components from external elements.

The engines 100, 200, 300, 400 described herein can be used on different types of lawn mowers than the zero-turn lawn mower 500 described herein. For example, the engine 200 can be used in an under-hood application on a riding tractor. As another example, the engines can be used on a riding mower that includes a mowing deck, a seat for the operator to sit in, and one or more blades or a drivetrain for one or more wheels (e.g., a transmission) driven by the engine. As another example, the engines can be used on a wide-area walk-behind walk mower that includes a mowing deck, one or more blades or a drivetrain for one or more wheels (e.g., a transmission), and a handle that allows the user to direct and control the mower while walking behind the mower. As another example, the engines can be used on a standing lawn mower that includes a mowing deck, a standing platform for the operator to stand on, and one or more blades or a drivetrain for one or more wheels (e.g., a transmission) driven by the engine.

The engines described herein have an overall package size that is smaller than a conventional V-twin engine. For example, the engines described herein are smaller in depth, measured from the front (e.g., front 102 proximate cylinder heads) to the rear (e.g., rear 104), than a typical V-twin engine. The engines may also be smaller in height or width than a typical V-twin engine. In some embodiments, the engines described herein are approximately 3 to 4 inches smaller (e.g., in depth, height, width) than a typical V-twin engine.

The engine includes a housing that is configured to house or contain the components of the engine. The packaging of the electrical components and fuel components underneath and contained within a housing decreases the exposure of these components to external elements, which decreases the likelihood that these components will be damaged due to being snagged, damaged, disconnected, etc. For example, fuel lines on conventional engines may be disconnected or otherwise damaged due to being snagged or caught on various objects during the assembly and operation of the engine. In addition, the incorporation of an electronic fuel system including electronic fuel injection and electronic governing allows for more variability in the placement of the components of the engine due to the elimination of a carburetor, mechanical governor, mechanical linkages, etc. As such, the electronic fuel system provides for a package design that is compact, where few or no components of the engine extend past the footprint of the engine block and housing described herein.

The positioning of one or more air filters proximate a top portion of the engine allows for easy accessibility for a user. The positioning of the electric fans above the cylinder heads creates an empty space above the flywheel, which allows for positioning one or more air filters above the flywheel instead thereby easing accessibility of the air filters for a user. As such, one or more of the engines described herein provide tool-less air filter access under the hood of a tractor or similar outdoor power equipment on which the engine is used such that a user can access and replace air filters as needed without the use of tools.

The overall sound emissions from the engines described herein are improved over conventional V-twin engines. Mechanical fans typically used in conventional V-twin engines may overcool the engine at lighter loads, which may lead to poor and inefficient combustion processes. Electric fans, on the other hand, can be more directly controlled to provide an appropriate amount of cooling air to the engine and engine components, which provides for more efficient combustion processes, less sound emission, and improved tonal sound quality. Thus, by using electric fans, the engines described herein may have lower sound emissions than typical V-twin engines. For at least the same reasons, the exhaust emissions from the engines described herein may be improved over typical engines due to the use of electric fans. In addition to lower emissions, the engines described herein improve on the power output from conventional V-twin engines due to the overall efficiency improvements described herein. For example, the engines described herein provide a potential power increase of approximately 1 horsepower. In addition, the engines described herein provide a fuel consumption reduction of up to 15% and more consistent operating temperatures.

Figure 31:
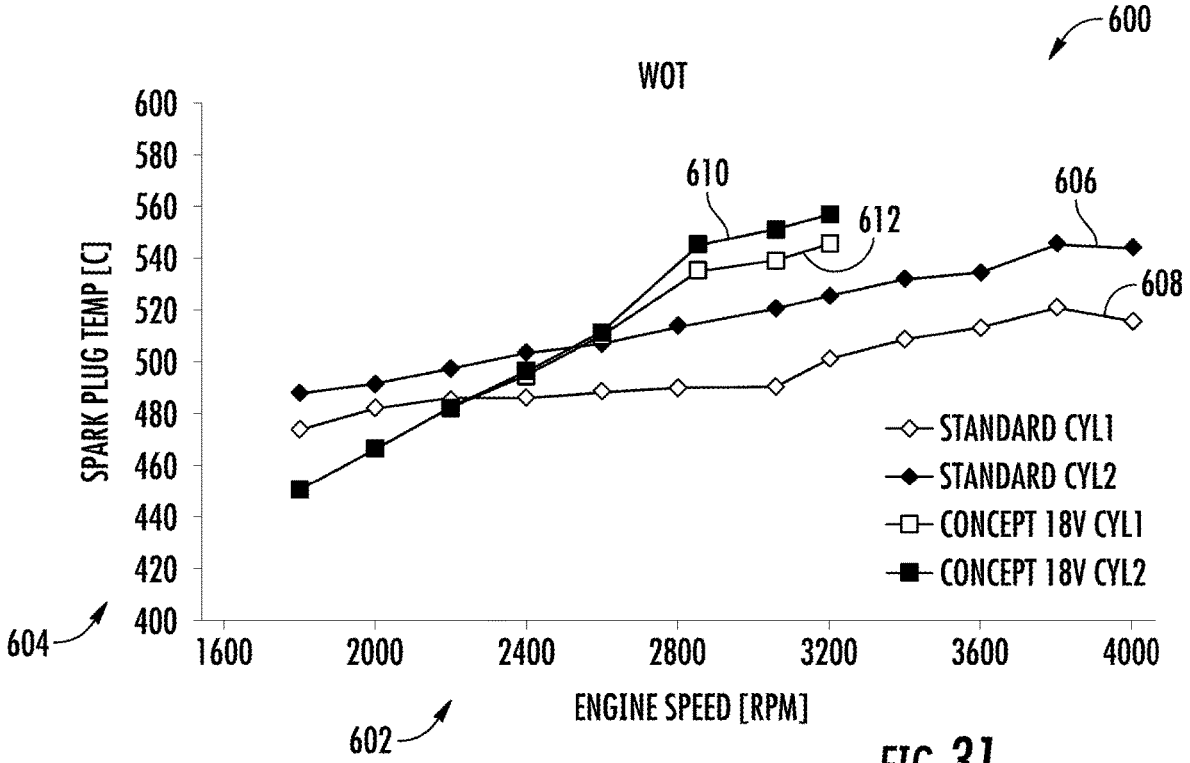
FIG. 31 is a graph illustrating spark plug temperature relative to engine speed.

Referring to FIGS. 31-36, various graphs are illustrated relating to the performance of the engines 100, 200, 300, 400 described herein. Referring to FIG. 31, a graph 600 showing the spark plug temperature 604 relative to the engine speed 602 is illustrated. As compared to a conventional V-twin engine (shown by graphed lines 606, 608), the engines 100, 200, 300, 400 described herein have less cylinder-to-cylinder temperature variation. For example, at approximately 3200 revolutions per minute (RPM), the conventional V-twin has a cylinder temperature variation of approximately 20 degrees Celsius and the engines described herein has a temperature variation of approximately less than 10 degrees Celsius.

Figure 32:
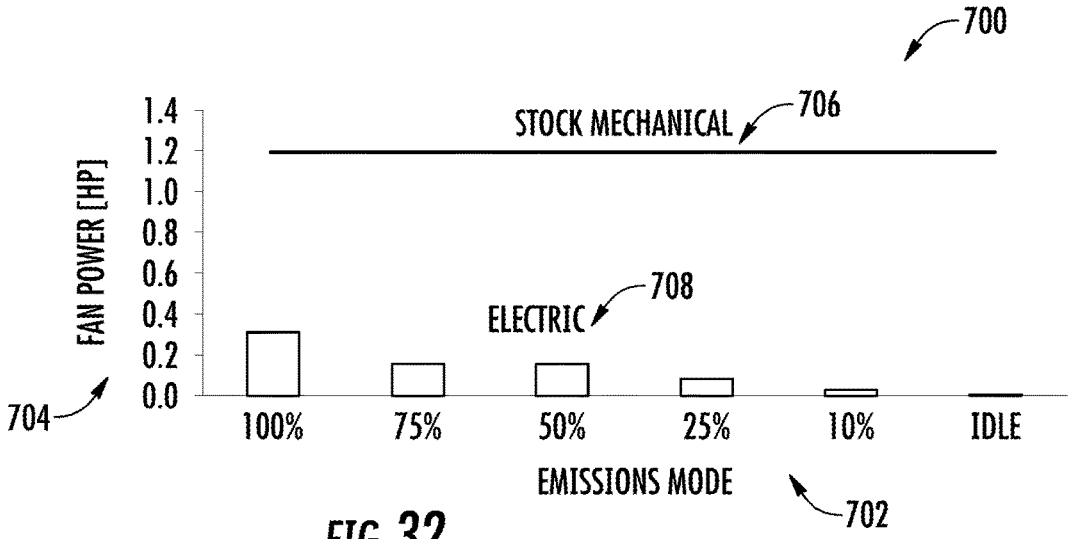
FIG. 32 is a graph illustrating fan power relative to emissions mode.

As shown in FIG. 32, a graph 700 showing the fan power 704 (horsepower) relative to the emissions mode 702 (e.g., throttle position) is illustrated. As illustrated, the fan voltage can be varied according to emission mode 702 to keep spark plug temperatures below certain temperatures (e.g., below 550 degrees Fahrenheit at wide-open throttle and 75% open throttle, below 500 degrees Fahrenheit at other modes). For example, at 50% throttle, the electric fan power 708 is approximately less than 0.2 hp relative to the stock mechanical fan 706, which is approximately 1.2 hp at every emission mode. Accordingly, electric fans can be controlled more efficiently, and at least at partial load, the engines described herein can provide better efficiency.

Figure 33:
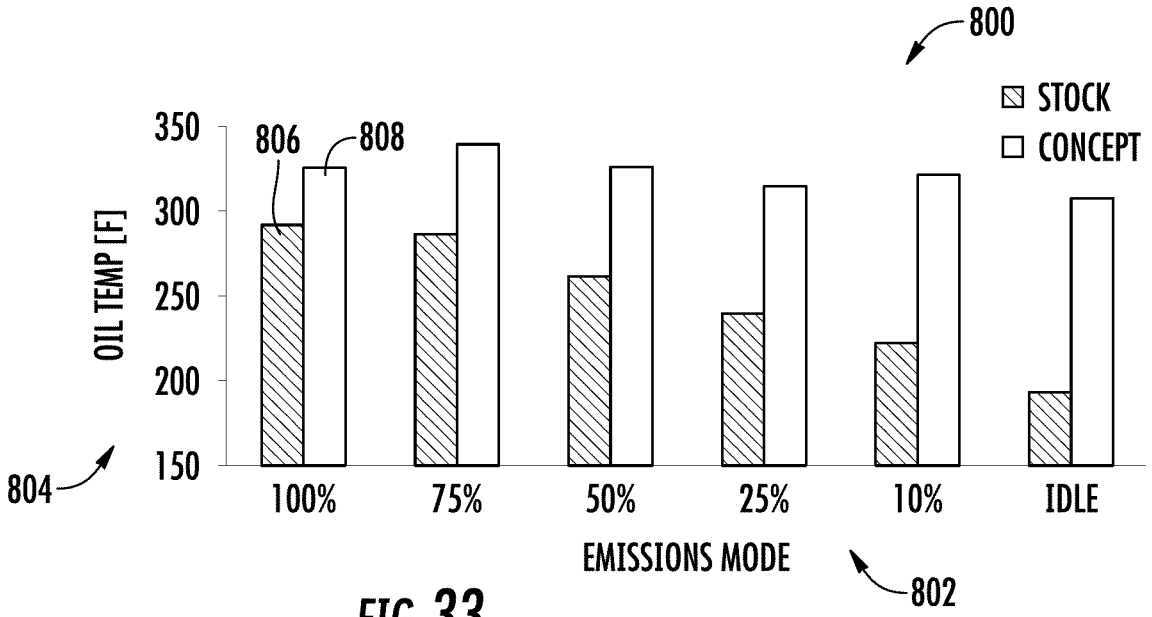
FIG. 33 is a graph illustrating oil temperature relative to emissions mode.
Figure 34:
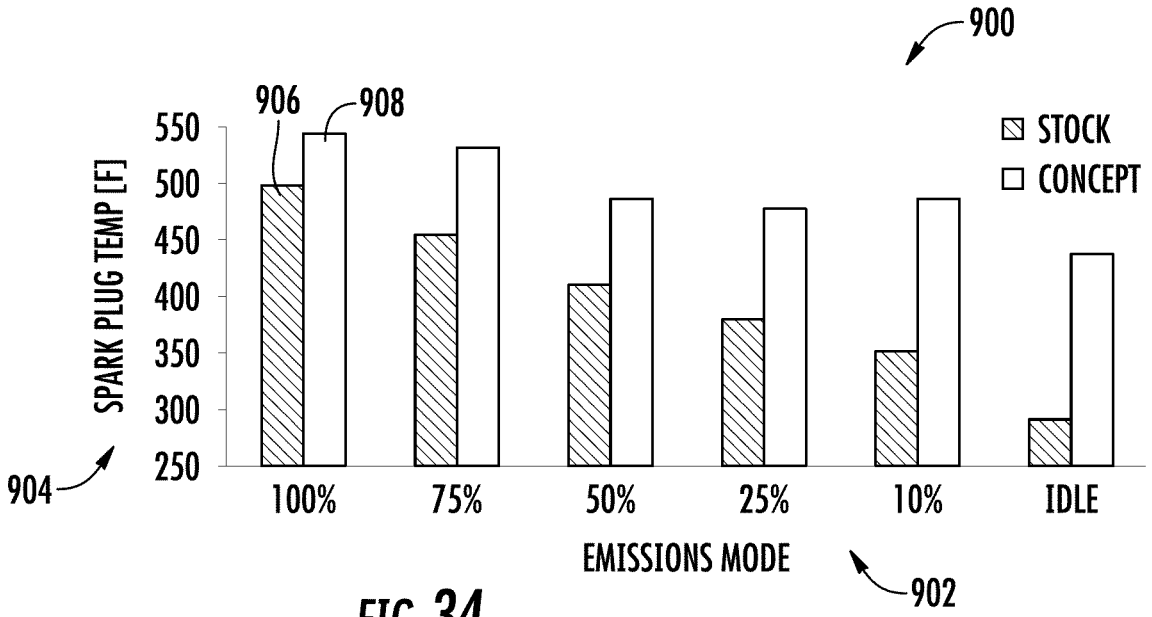
FIG. 34 is a graph illustrating spark plug temperature relative to emissions mode.
Figure 35:
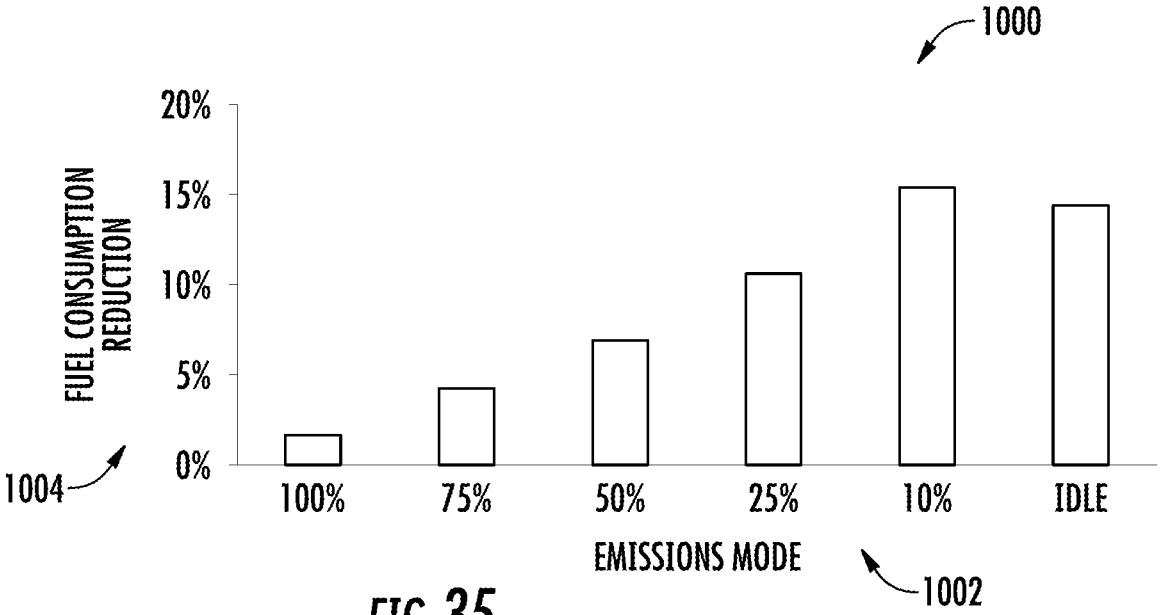
FIG. 35 is a graph illustrating fuel consumption reduction relative to emissions mode.
Figure 36:
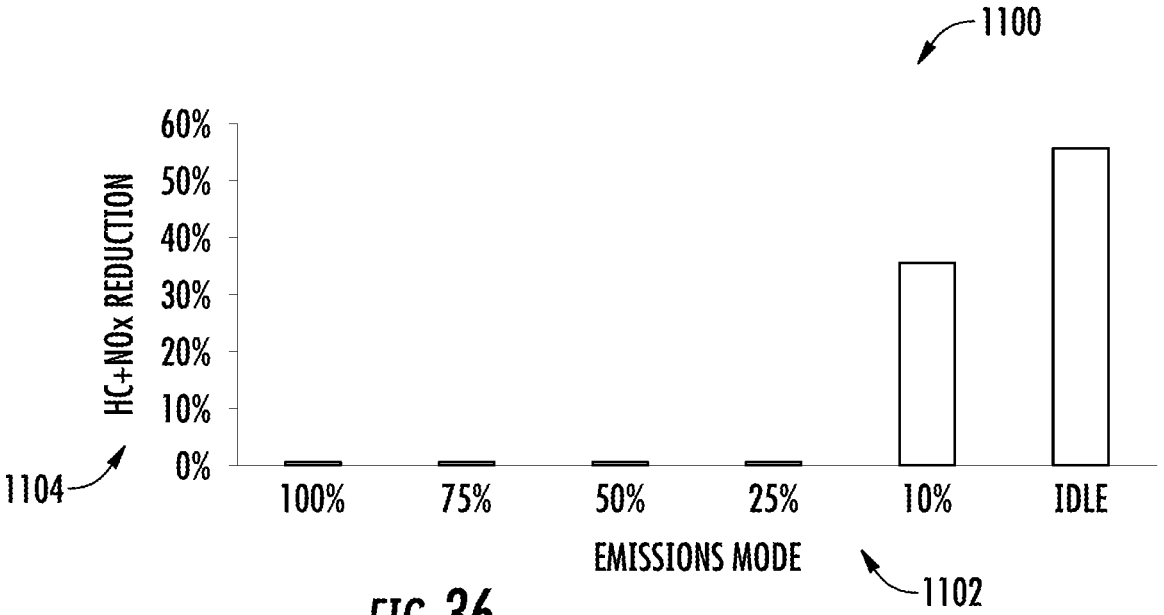
FIG. 36 is a graph illustrating emissions reduction relative to emissions mode.

As shown in FIGS. 33-34, graphs 800, 900 showing the oil temperature 804 and spark plug temperature 904 relative to the emissions mode 802, 902 (e.g., throttle position) are illustrated. As illustrated, the oil and spark plug temperatures of the conventional V-twin engine 806, 906 are relatively lower across all emission modes 802, 902 than the oil and spark plug temperatures of the engines described herein 808, 908. Accordingly, the oil and spark plug temperatures of the engines described herein are controlled more effectively such that the temperatures do not get too cool, thereby allowing for more complete combustion processes and reducing the emissions of the engines described herein. FIGS. 35-36 show graphs 1000, 1100 which illustrate the fuel consumption reduction 1004 and emissions reduction 1104 relative to the emissions mode 1002, 1102.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

Unless described differently above, the terms "coupled," "connected," and the like, as used herein, mean the joining of two members directly or indirectly to one another. Such joining may be stationary (e.g., permanent) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A zero-turn mower comprising:
- a user seat;
- a first rear wheel and a second rear wheel;
- a mounting platform; and
- an internal combustion engine positioned on the mounting platform between the first rear wheel and the second rear wheel comprising:
  - an engine block including a first cylinder and a second cylinder wherein the first cylinder and the second cylinder are arranged in a V-twin configuration including a space between the first cylinder and the second cylinder;
  - a crankshaft configured to rotate about a crankshaft axis;
  - a flywheel coupled to the crankshaft;
  - a throttle body configured to throttle incoming air to the first cylinder and the second cylinder;
  - an air filter assembly positioned proximate the flywheel and configured to filter incoming air from an air intake and provide cleaned air to the throttle body, wherein the air filter assembly comprises one or more filter elements each positioned within a receptacle and configured to provide two stages of filtration and
  - a muffler positioned within the space between the first cylinder and the second cylinder, the muffler comprising an angled portion located between the first cylinder and the second cylinder.

2. The mower of claim 1, wherein the engine further includes an electric fan.

3. The mower of claim 2, wherein the electric fan is positioned directly adjacent the first cylinder.

4. The mower of claim 2, wherein the electric fan comprises a first electric fan and is positioned adjacent the first cylinder;
- wherein the engine further comprises a second electric fan positioned adjacent the second cylinder.

5. The mower of claim 4, wherein the first electric fan rotates about a first fan axis substantially perpendicular to the crankshaft axis and the second electric fan rotates about a second fan axis substantially perpendicular to the crankshaft axis.

6. The mower of claim 1, further comprising:
- a first fuel delivery injector configured to provide fuel to the first cylinder; and
- a second fuel delivery injector configured to provide fuel to the second cylinder.

7. The mower of claim 6, wherein the first fuel delivery injector and the second fuel delivery injector are angled relative to a vertical plane that includes the crankshaft axis.

8. The mower of claim 6, wherein the engine further comprises:
- an electronic governor system structured to maintain a specified engine speed; and
- a controller communicably coupled to the electronic governor system, the first fuel delivery injector, and the second fuel delivery injector.

9. The mower of claim 8, wherein the engine further comprises:
- a housing configured to direct cooling air over the engine block, comprising:
  - a first ducting portion configured to direct cooling air directly over the first cylinder, wherein the first cylinder is at least partially within the first ducting portion;
  - a second ducting portion configured to direct cooling air directly over the second cylinder, wherein the second cylinder is at least partially within the second ducting portion;
- a first electric fan within the first ducting portion and communicably coupled to the controller, the first electric fan rotating about a first fan axis not parallel to the crankshaft axis; and
- a second electric fan within the second ducting portion and communicably coupled to the controller, the second electric fan rotating about a second fan axis not parallel to the crankshaft axis.

10. The mower of claim 1, further comprising a battery positioned on an opposite side of the engine from the air filter assembly.

11. The mower of claim 1, wherein the muffler fits within an overall footprint of the engine.

12. The mower of claim 1, further including;
- a spark plug; and
- a housing configured to direct cooling air over the engine block, comprising:
  - a ducting portion configured to direct cooling air directly over the first cylinder and the second cylinder, wherein the first cylinder and the second cylinder are at least partially within the ducting portion;

wherein the ducting portion further includes an aperture, and wherein the spark plug extends at least partially through the aperture.

13. The mower of claim 2, further including a screen coupled to the electric fan, wherein the screen rotates with the electric fan.

14. The mower of claim 1, further comprising:

a housing configured to direct cooling air over the engine block, comprising:

a ducting portion configured to direct cooling air directly over the first cylinder and the second cylinder, wherein the first cylinder and the second cylinder are at least partially within the ducting portion.

15. The mower of claim 14, wherein the ducting portion comprises a first ducting portion configured to direct cooling air directly over the first cylinder and includes a first electric fan within the first ducting portion;

wherein the housing further comprises a second ducting portion configured to direct cooling air directly over the second cylinder and includes a second electric fan within the second ducting portion.

16. The mower of claim 15, wherein the first electric fan rotates about a first fan axis not parallel to the crankshaft axis and the second electric fan rotates about a second fan axis not parallel to the crankshaft axis.

17. The mower of claim 15, wherein the first electric fan rotates about a first fan axis not collinear to the crankshaft axis and the second electric fan rotates about a second fan axis not collinear to the crankshaft axis.

18. The mower of claim 15, wherein the air filter assembly is substantially adjacent the flywheel.

19. The mower of claim 15, wherein the engine further comprises:

an alternator configured to transform mechanical energy into electrical energy; and a battery electrically coupled to the alternator.

* * * * *